US008022905B2

(12) United States Patent
Yamashita et al.

(10) Patent No.: US 8,022,905 B2
(45) Date of Patent: Sep. 20, 2011

(54) DISPLAY DEVICE, DRIVING METHOD OF THE SAME AND ELECTRONIC APPARATUS USING THE SAME

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 572 days.

(21) Appl. No.: 12/232,041

(22) Filed: Sep. 10, 2008

(65) Prior Publication Data

US 2009/0085903 A1 Apr. 2, 2009

(30) Foreign Application Priority Data

Sep. 27, 2007 (JP) ..... 2007-250572

(51) Int. Cl.
*G09G 3/30* (2006.01)

(52) U.S. Cl. ..... 345/76

(58) Field of Classification Search ..... None
See application file for complete search history.

(56) References Cited

U.S. PATENT DOCUMENTS

| | | | |
|---|---|---|---|
| 7,057,588 | B2 | 6/2006 | Asano et al. |
| 7,102,202 | B2 | 9/2006 | Kobayashi et al. |
| 7,109,952 | B2 | 9/2006 | Kwon et al. |
| 2005/0206590 | A1 | 9/2005 | Sasaki et al. |
| 2006/0170628 | A1 | 8/2006 | Yamashita et al. |
| 2007/0247399 | A1 | 10/2007 | Yamashita et al. |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2006-017815 | A | 1/2006 |
| JP | 2006-215213 | | 8/2006 |
| JP | 2008-009198 | A | 1/2008 |

OTHER PUBLICATIONS

Japanese Office Action issued Aug. 27, 2009 for corresponding Japanese Application No. 2007-250572.

*Primary Examiner* — Tammy Pham
(74) *Attorney, Agent, or Firm* — Rader, Fishman & Grauer PLLC

(57) ABSTRACT

A display device includes a pixel array section and a driving section. The pixel array section includes scanning lines arranged in rows, signal lines arranged in columns, and pixels arranged in a matrix. Each of the pixels includes at least a sampling transistor, a drive transistor, a holding capacitance, and a light-emitting device. The sampling transistor has its control terminal connected to the scanning line and its pair of current terminals connected between the signal line and the control terminal of the drive transistor. The drive transistor has one of its pair of current terminals connected to the light-emitting device and the other of its pair of current terminals connected to a power source. The holding capacitance is connected between the control and current terminals of the drive transistor.

6 Claims, 26 Drawing Sheets

$$Ids=k\mu(Vgs-Vth)^2=k\mu(Vsig-\Delta V)^2$$

DISPLAY DEVICE, DRIVING METHOD OF THE SAME AND ELECTRONIC APPARATUS USING THE SAME

CROSS REFERENCES TO RELATED APPLICATIONS

The present invention contains subject matter related to Japanese Patent Application JP 2007-250572 filed in the Japan Patent Office on Sep. 27, 2007, the entire contents of which being incorporated herein by reference.

BACKGROUND OF THE INVENTION

1. Field of the Invention

The present invention relates to a display device for current-driving a light-emitting device provided in each pixel to display an image and a driving method of the same. The present invention also relates to electronic apparatus using such a display device. More specifically, the present invention relates to a driving method of a so-called active matrix display device for controlling the amount of current to be passed through an organic electroluminescence (EL) device or other light emitting device by means of an insulating gate field effect transistor provided in each pixel circuit.

2. Description of the Related Art

A display device such as liquid crystal display has a number of liquid crystal pixels arranged in a matrix. Such a display device displays an image by controlling the transmission or reflection intensity of incident beam for each pixel according to image information to be displayed. This is also true for an organic EL display using organic EL devices. However, an organic EL device is self-luminous unlike a liquid crystal pixel. As a result, an organic EL display device offers several advantages over a liquid crystal display device. Such advantages include high image visibility, no need for backlight and high response speed of the device. Further, the brightness level (gray level) of each light-emitting device can be controlled by controlling the current level flowing through the same device. As a result, an organic EL display differs significantly from a liquid crystal display or other voltage-controlled display in that it is a so-called current-controlled display.

An organic EL display can be either simple (passive)-matrix or active-matrix driven as with a liquid crystal display. The former has some problems although simple in construction. Such problems include difficulty in implementing a large high-definition display device. For this reason, the development of active matrix displays is going on at a brisk pace today. Such displays, described in the documents listed below, control the current flowing through the light-emitting device in the pixel circuit with an active device (typically, thin film transistor or TFT) provided in the same pixel circuit, as is disclosed in Japanese Patent Laid-Open Nos. 2003-255856, 2003-271095, 2004-133240, 2004-029791, 2004-093682 and 2006-215213.

SUMMARY OF THE INVENTION

The pixel circuit in related art is provided at the intersection of one of scanning lines arranged in rows to supply a control signal and one of signal lines arranged in columns to supply a video signal. Each of such pixel circuits includes at least a sampling transistor, holding capacitance, drive transistor and light-emitting device. The sampling transistor conducts in response to a drive signal from the scanning line to sample the video signal from the signal line. The holding capacitance holds an input voltage appropriate to the video signal potential sampled. The drive transistor supplies an output current as a drive current during a given light emission period according to the input voltage held by the holding capacitance. It should be noted that the output current is typically dependent upon the carrier mobility and threshold voltage in the channel region of the drive transistor. The light-emitting device emits light at the brightness appropriate to the video signal when supplied with the output current from the drive transistor.

When receiving the input voltage held by the holding capacitance at its gate (i.e., control terminal), the drive transistor permits the output current to flow from its source to drain (i.e., a pair of current terminals), thus passing the current through the light-emitting device. The light emission brightness of the light-emitting device is typically proportional to the amount of current passing through the same device. Further, the amount of the output current supplied by the drive transistor is controlled by the gate voltage, namely, the input voltage written to the holding capacitance. A pixel circuit in related art varies the input voltage applied to the gate of the drive transistor in response to the input video signal, thus controlling the amount of current supplied to the light-emitting device.

Here, the operating characteristic of the drive transistor is expressed by the formula 1 shown below.

$$Ids=(1/2)\mu(W/L)\mathrm{Cox}(Vgs-Vth)^2 \qquad \text{Formula 1}$$

In this transistor characteristic formula 1, Ids represents the drain current flowing from the source to drain. In the pixel circuit, Ids is the output current supplied to the light-emitting device. Vgs represents the gate voltage applied to the gate relative to the source. In the pixel circuit, Vgs is the input voltage described above. Vth represents the transistor threshold voltage. μ represents the mobility of a semiconductor thin film making up the channel of the transistor. Further, W represents the channel width, L the channel length and Cox the gate capacitance. As is clear from the transistor characteristic formula 1, if the gate voltage Vgs increases beyond the threshold voltage Vth when the thin film transistor operates in the saturation region, the transistor turns on, causing the drain current Ids to flow. In principle, if the gate voltage Vgs is constant, the same amount of the drain current Ids is supplied at all times, as shown by the transistor characteristic formula 1. Therefore, if a video signal of the same level is supplied to each of the pixels making up the screen, all the pixels should emit light at the same brightness, thus ensuring screen uniformity.

Actually, however, thin film transistors (TFTs) which include a semiconductor thin film such as polysilicon vary in characteristics from each other. In particular, the threshold voltage Vth is not constant but differs from one pixel to another. As is clear from the above transistor characteristic formula 1, a variation in the threshold voltage Vth between the drive transistors leads to a variation in the drain current Ids therebetween even if the gate voltage Vgs is constant, thus impairing the screen uniformity. Pixel circuits have been available which incorporate the function to cancel the variation in the threshold voltage of the drive transistor. One of such pixel circuits in related art is disclosed, for example, in Japanese Patent Laid-Open No. 2004-133240.

However, the variation in the output current supplied to the light-emitting device is not attributable to the threshold voltage Vth of the drive transistor alone. As is clear from the above transistor formula 1, the output current Ids varies also with variation in the mobility μ of the drive transistor, thus impairing the screen uniformity. Pixel circuits have been available which incorporate the function to correct the variation in the mobility of the drive transistor. One of such pixel circuits in related art is disclosed, for example, in Japanese Patent Laid-Open No. 2006-215213.

The pixel circuit in related art incorporating the mobility correction function negatively feeds back the drive current flowing through the drive transistor to the holding capacitance according to the signal potential during a given correction period, thus adjusting the signal potential held by the holding capacitance. The larger the drive transistor mobility becomes, the larger the negative feedback amount becomes, thus increasing the reduction of the signal potential and eventually suppressing the drive current. In contrast, the smaller the drive transistor mobility becomes, the smaller the amount of negative feedback to the holding capacitance becomes. As a result, the signal potential held by the holding capacitance declines to a small extent. Therefore, the drive current does not decline so much. As described above, the signal potential is adjusted in such a manner as to cancel the difference in the drive transistor mobility between the different pixels. This allows the different pixels to emit light at almost the same brightness for the same signal potential, irrespective of the variation in the drive transistor mobility between the different pixels.

The above mobility correction operation is conducted during a given mobility correction period. To improve the screen uniformity, it is important to correct the mobility under the optimal condition. However, the optimal mobility correction time is not constant but is, in reality, dependent upon the video signal level. Typically, if the video signal potential is high (as when white is displayed at a high light emission brightness), the optimal mobility correction time tends to be shorter. In contrast, if the signal potential is not so high (as when gray or black is displayed), the optimal mobility correction time tends to be longer. However, display devices in related art have not always been designed with the optimal mobility correction time for the video signal potential in mind. This has been a problem to be solved in order to provide improved screen uniformity.

In light of the foregoing problems with the related art, it is desirable to perform mobility correction properly according to the gray level of the video signal (video signal level) so as to provide improved screen uniformity. In order to achieve the above goal, the following measures have been taken. That is, the display device according to an embodiment of the present invention includes a pixel array section and driving section. The pixel array section includes scanning lines arranged in rows, signal lines arranged in columns and pixels arranged in a matrix, each of which is provided at the intersection of one of the scanning lines and one of the signal lines. Each pixel includes at least a sampling transistor, drive transistor, holding capacitance and light-emitting device. The sampling transistor has its control terminal connected to the scanning line. The same transistor has its pair of current terminals connected between the signal line and the control terminal of the drive transistor. The drive transistor has one of its pair of current terminals connected to the light-emitting device and the other of its pair of current terminals connected to a power source. The holding capacitance is connected between the control and current terminals of the drive transistor. The driving section includes at least a write scanner and signal selector. The write scanner supplies a control signal to each of the scanning lines for line-sequentially scanning. The signal selector supplies a video signal to each of the signal lines. The sampling transistor turns on in response to the control signal supplied to the scanning line to sample the video signal from the signal line and write the sampled video signal to the holding capacitance. Further, the sampling transistor negatively feeds the current flowing from the drive transistor back to the holding capacitance during a given correction period lasting until the same transistor turns off in response to the control signal. This applies the correction of the mobility of the drive transistor to the video signal level written to the holding capacitance. The drive transistor supplies a current appropriate to the video signal level written to the holding capacitance to the light-emitting device, thus causing the same device to emit light. The write scanner includes a shift register and output buffers. The shift register sequentially generates an input signal from each of its stages in synchronism with line-sequentially scanning. Each of the output buffers is connected between one of the stages of the shift register and one of the scanning lines. The same buffer outputs a control signal to the scanning line in response to the input signal. The same buffer varies the trailing edge waveform of the control signal at least in two steps in response to the input signal, thus variably controlling the correction period according to the video signal level. The control signal defines the timing at which the sampling transistor turns off.

According to an embodiment of the present invention, there is provided a driving method for a display device, the display device including a pixel array section and driving section. The pixel array section includes scanning lines arranged in rows, signal lines arranged in columns and pixels arranged in a matrix, each of which is provided at the intersection of one of the scanning lines and one of the signal lines. Each pixel includes at least a sampling transistor, drive transistor, holding capacitance and light-emitting device. The sampling transistor has its control terminal connected to the scanning line. The same transistor has its pair of current terminals connected between the signal line and the control terminal of the drive transistor. The drive transistor has one of its pair of current terminals connected to the light-emitting device and the other of its pair of current terminals connected to a power source. The holding capacitance is connected between the control and current terminals of the drive transistor. The driving section includes at least a write scanner and signal selector. The write scanner supplies a control signal to each of the scanning lines for line-sequentially scanning. The signal selector supplies a video signal to each of the signal lines. The sampling transistor turns on in response to the control signal supplied to the scanning line to sample the video signal from the signal line and write the sampled video signal to the holding capacitance. Further, the sampling transistor negatively feeds the current flowing from the drive transistor back to the holding capacitance during a given correction period lasting until the same transistor turns off in response to the control signal. This applies the correction of the mobility of the drive transistor to the video signal level written to the holding capacitance. The drive transistor supplies a current appropriate to the video signal level written to the holding capacitance to the light-emitting device, thus causing the same device to emit light. The method includes the step of: providing the write scanner including a shift register and output buffers; sequentially generating an input signal from each of the stages of the shift register in synchronism with line-sequentially scanning; outputting a control signal to the scanning lines in response to the input signal from each of the output buffers connected between one of the stages of the shift register and one of the scanning lines; and allowing the output buffer to vary the trailing edge waveform of the control signal, adapted to define the timing at which the sampling transistor turns off, at least in two steps in response to the input signal so as to variably control the correction period according to the video signal level.

According to an embodiment of the present invention, there is provided an electronic apparatus including a display device. The display device includes a pixel array section and driving section. The pixel array section includes scanning lines arranged in rows, signal lines arranged in columns and pixels arranged in a matrix, each of which is provided at the intersection of one of the scanning lines and one of the signal lines. Each pixel includes at least a sampling transistor, drive transistor, holding capacitance and light-emitting device. The sampling transistor has its control terminal connected to the scanning line. The same transistor has its pair of current terminals connected between the signal line and the control terminal of the drive transistor. The drive transistor has one of its pair of current terminals connected to the light-emitting device and the other of its pair of current terminals connected to a power source. The holding capacitance is connected between the control and current terminals of the drive transistor. The driving section includes at least a write scanner and signal selector. The write scanner supplies a control signal to each of the scanning lines for line-sequentially scanning. The signal selector supplies a video signal to each of the signal lines. The sampling transistor turns on in response to the control signal supplied to the scanning line to sample the video signal from the signal line and write the sampled video signal to the holding capacitance. Further, the sampling transistor negatively feeds the current flowing from the drive transistor back to the holding capacitance during a given correction period lasting until the same transistor turns off in response to the control signal. This applies the correction of the mobility of the drive transistor to the video signal level written to the holding capacitance. The drive transistor supplies a current appropriate to the video signal level written to the holding capacitance to the light-emitting device, thus causing the same device to emit light. The write scanner includes a shift register and output buffers. The shift register sequentially generates an input signal from each of its stages in synchronism with line-sequentially scanning. Each of the output buffers is connected between one of the stages of the shift register and one of the scanning lines. The same buffer outputs a control signal to the scanning line in response to the input signal. The same buffer varies the trailing edge waveform of the control signal at least in two steps in response to the input signal, thus variably controlling the correction period according to the video signal level. The control signal defines the timing at which the sampling transistor turns off.

According to an embodiment of the present invention, the output buffer of the write scanner varies the trailing edge waveform of the control signal in a step-by-step manner in response to the input signal supplied from one of the stages of the shift register of the write scanner. The control signal defines the timing at which the sampling transistor turns off. Such a configuration allows the sampling transistor to variably control the mobility correction period in an automatic fashion according to the video signal level (gray level). Thus, the present invention permits mobility correction according to the gray level of the video signal, ensuring improved screen uniformity.

In the present invention in particular, the output buffer of the write scanner generates a trailing edge waveform of the control signal to be fed to the sampling transistor. Thus, the write scanner itself generates a trailing edge waveform of the control signal, eliminating the need for any external module adapted to separately generate a gate pulse. The write scanner can be integrated together with the pixel array section on a panel. The present invention eliminates the need for external module adapted to generate a gate pulse, thus providing reduced power consumption. This makes the present invention particularly suited for use in mobile equipment. Further, the present invention provides cost reduction because no external module is required. Still further, the present invention provides size reduction because no redundant mounting space is required.

DETAILED DESCRIPTION OF THE PREFERRED EMBODIMENTS

Figure 1:
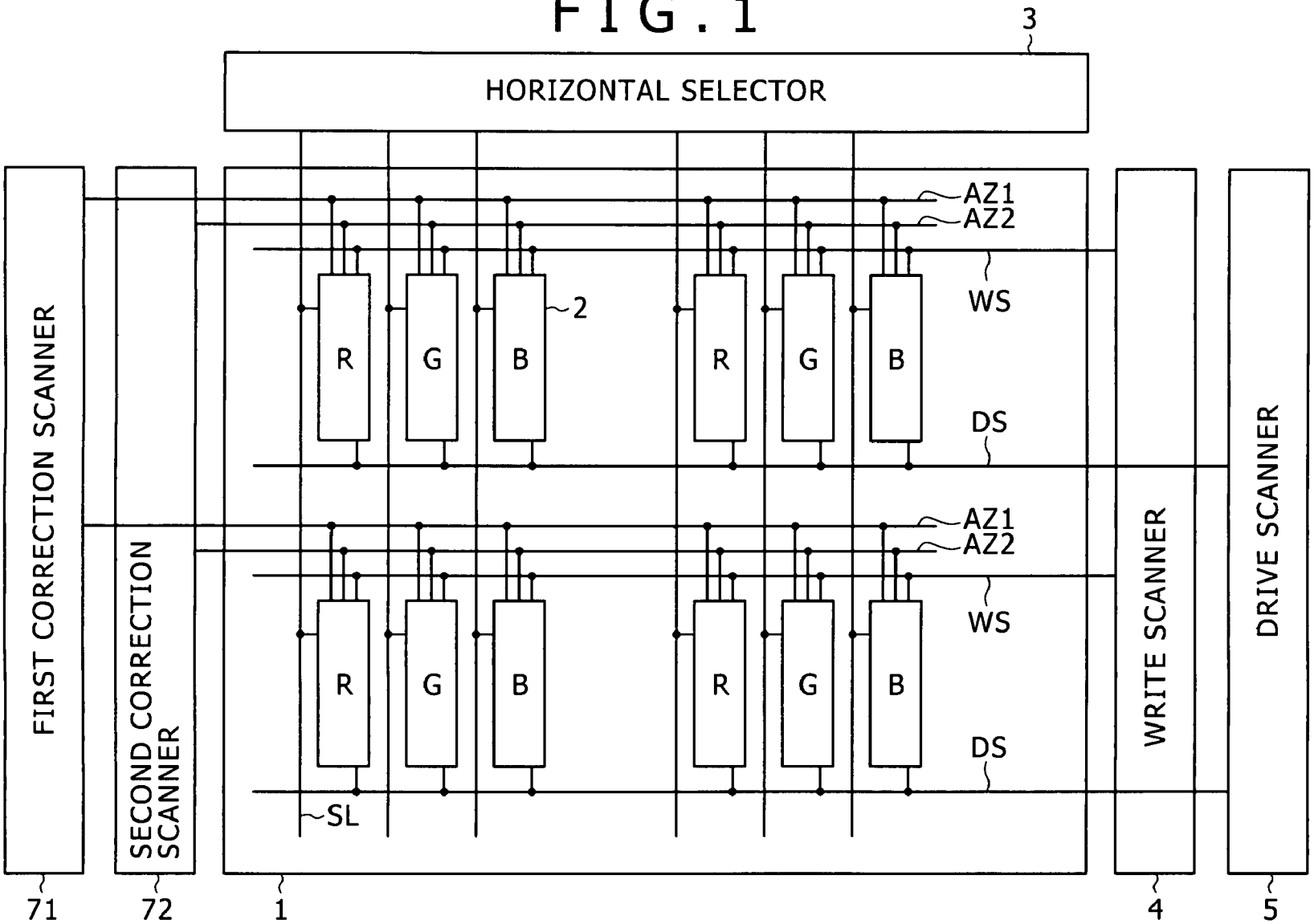
FIG. 1 is a block diagram illustrating the overall configuration of a display device according to an embodiment of the present invention.

The preferred embodiments of the present invention will be described below with reference to the accompanying drawings. FIG. 1 is a block diagram illustrating the overall configuration of the display device according to an embodiment of the present invention. As illustrated in FIG. 1, the present display device basically includes a pixel array section 1, scanner section and signal section. The scanner section and signal section make up a driving section. The pixel array section 1 includes first, second, third and fourth scanning lines WS, DS, AZ1 and AZ2 arranged in rows and signal lines SL arranged in columns. The pixel array section 1 further includes pixel circuits 2 arranged in a matrix which are connected to the scanning lines WS, DS, AZ1 and AZ2 and signal lines SL. The pixel array section 1 still further includes a plurality of power lines adapted to supply first, second and third potentials Vss1, Vss2 and VDD required for the operation of the pixel circuits 2. The signal section includes a horizontal selector 3 to supply a video signal to the signal lines SL. The scanner section includes a write scanner 4, drive scanner 5 and first and second correction scanners 71 and 72. These scanners supply control signals respectively to the first, second, third and fourth scanning lines WS, DS, AZ1 and AZ2 to sequentially scan the pixel circuits 2 on a row-by-row basis.

Figure 2:
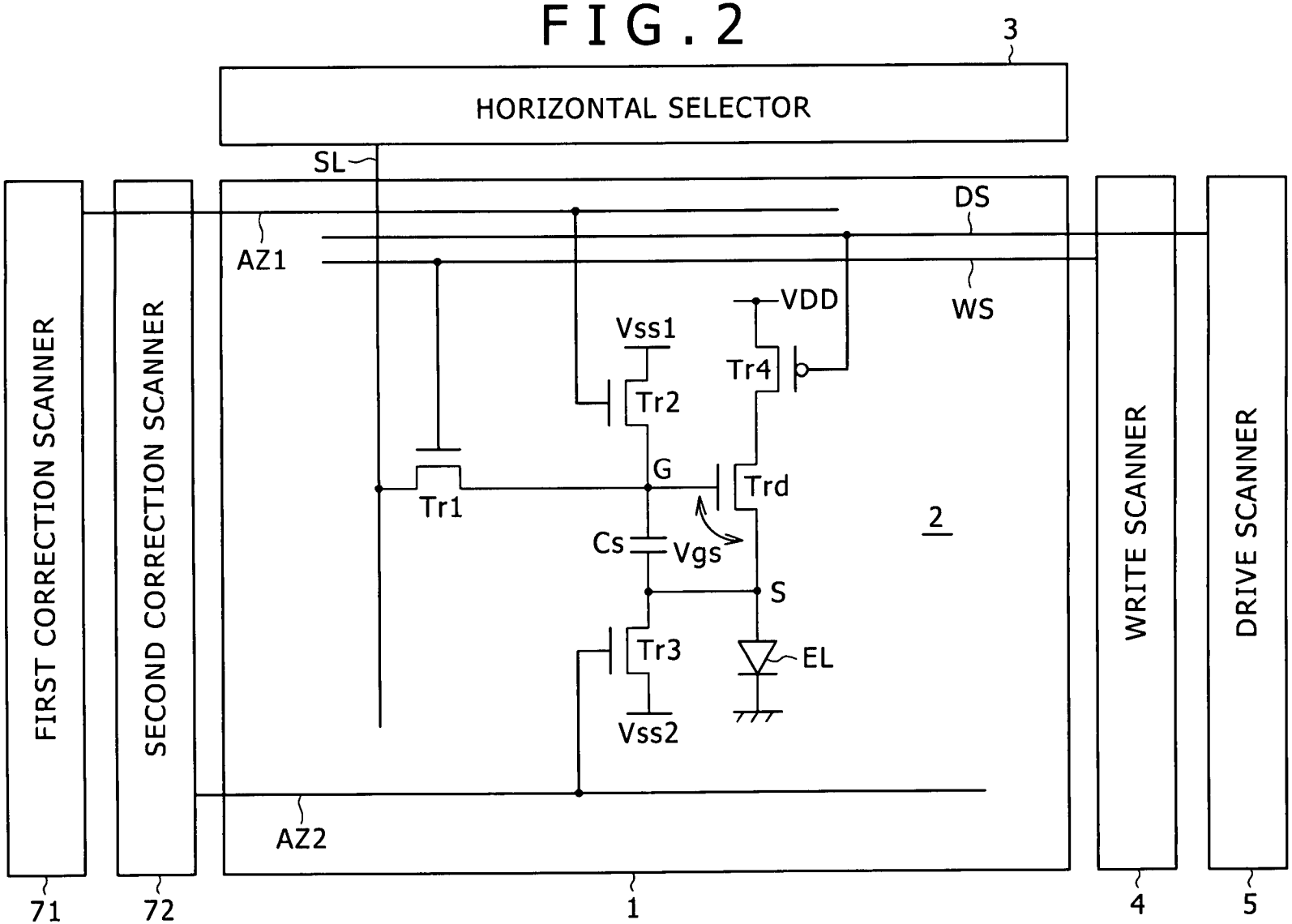
FIG. 2 is a circuit diagram illustrating the configuration of a pixel contained in the display device illustrated in FIG. 1.

FIG. 2 is a circuit diagram illustrating the configuration of a pixel incorporated in the image display device illustrated in FIG. 1. As illustrated in FIG. 2, the pixel circuit 2 includes a sampling transistor Tr1, drive transistor Trd, first, second and third switching transistors Tr2, Tr3 and Tr4, holding capacitance Cs and light-emitting device EL. The sampling transistor Tr1 conducts in response to a control signal supplied from the scanning line WS during a given sampling period to sample the video signal potential supplied from the signal line SL into the holding capacitance Cs. The holding capacitance Cs applies the input voltage Vgs to a gate G of the drive transistor Trd according to the video signal potential sampled. The drive transistor Trd supplies the output current Ids, appropriate to the input voltage Vgs, to the light-emitting device EL. The light-emitting device EL emits light at the brightness appropriate to the video signal potential when supplied with the output current Ids from the drive transistor Trd during a given light emission period.

The first switching transistor Tr2 conducts in response to a control signal supplied from the scanning line AZ1 ahead of the sampling period (video signal write period) to set the gate G, i.e., the control terminal, of the drive transistor Trd to the first potential Vss1. The second switching transistor Tr3 conducts in response to a control signal supplied from the scanning line AZ2 ahead of the sampling period to set a source S, i.e., one of the current terminals, of the drive transistor Trd to the second potential Vss2. The third switching transistor Tr4 conducts in response to a control signal supplied from the scanning line DS ahead of the sampling period to connect a drain, i.e., the other current terminal, of the drive transistor Trd to the third potential VDD. By doing so, the third switching transistor Tr4 causes the holding capacitance Cs to hold a voltage corresponding to the threshold voltage Vth of the drive transistor Trd, thus correcting the impact of the threshold voltage Vth. Further, the third switching transistor Tr4 conducts again in response to a control signal supplied from the scanning line DS during the light emission period to connect the drive transistor Trd to the third potential VDD, thus causing the output current Ids to flow through the light-emitting device EL.

As is clear from the above description, the pixel circuit 2 includes the five transistors Tr1 to Tr4 and Trd, one holding capacitance Cs and one light-emitting device EL. The transistors Tr1 to Tr3 and Trd are N-channel polysilicon TFTs. The transistor Tr4 is a P-channel polysilicon TFT. It should be noted, however, that the present invention is not limited to the above, but N- and P-channel TFTs may be combined as appropriate. The light-emitting device EL is, for example, a diode-type organic EL device having a cathode and anode. It should be noted, however, that the present invention is not limited to the above, but the light-emitting device may be any device which typically emits light when driven by a current.

Figure 3:
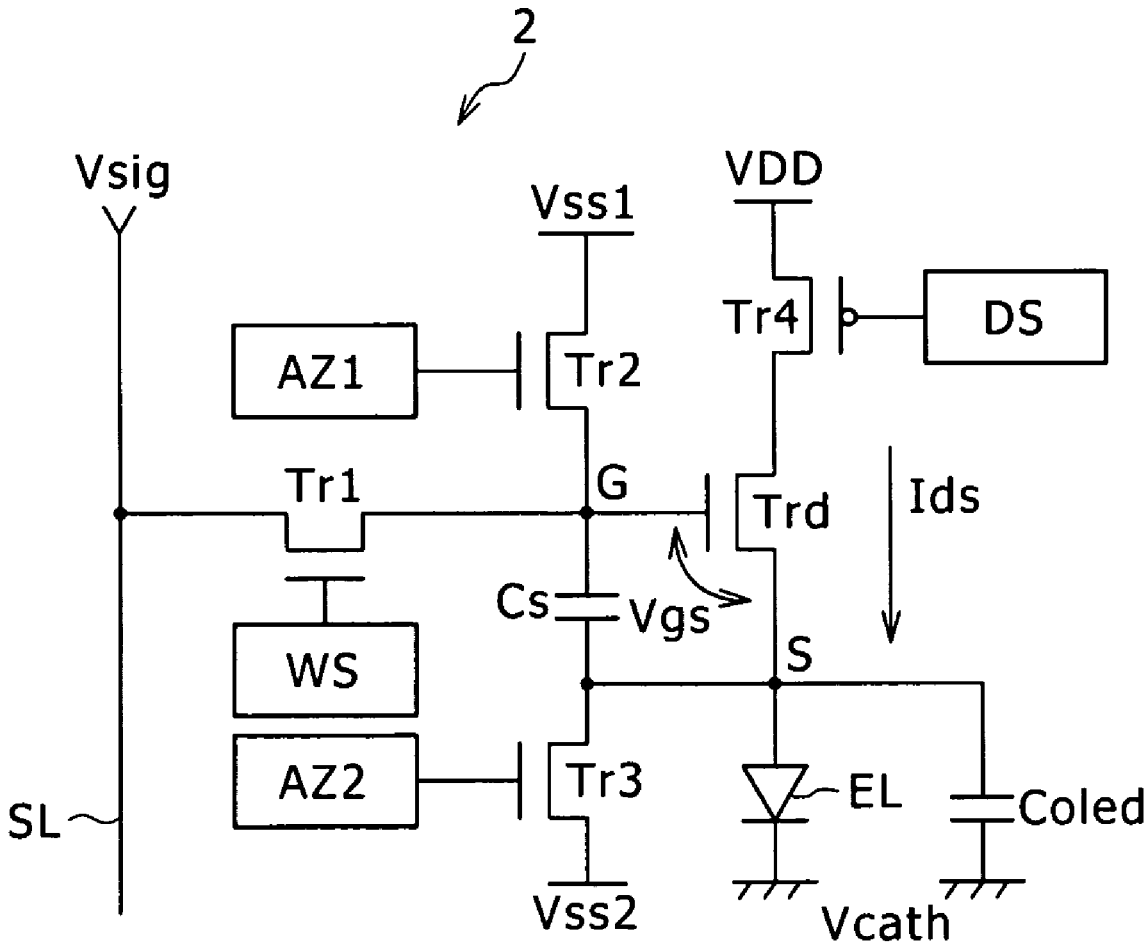
FIG. 3 is a circuit diagram similarly illustrating the pixel configuration.

FIG. 3 is a schematic diagram illustrating the pixel circuit 2 in the image display device shown in FIG. 2. For easier understanding, additions have been made, including a video signal potential Vsig which is sampled by the sampling transistor Tr1, the input voltage Vgs and output current Ids of the drive transistor Trd and a capacitive component Coled of the light-emitting device EL. The operation of the pixel circuit 2 according to an embodiment of the present invention will be described below based on FIG. 3.

Figure 4:
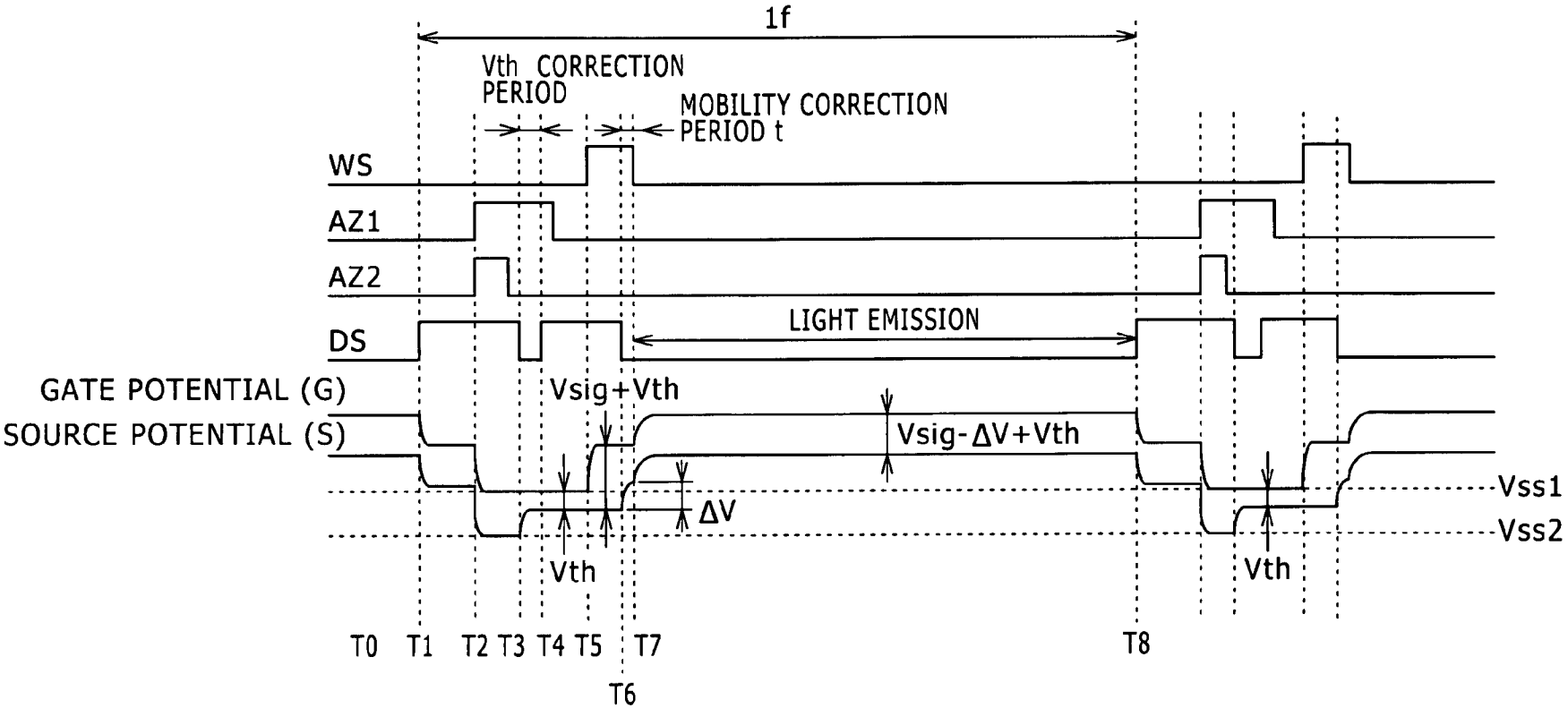
FIG. 4 is a timing chart used for describing the operation of the display device illustrated in FIGS. 1 and 2.

FIG. 4 is a timing chart of the pixel circuit illustrated in FIG. 3. This timing chart illustrates the driving system according to the related art on which an embodiment of the present invention is based. To clarify the background of the present invention and facilitate the understanding thereof, the driving system according to the related art will be described first in a concretive manner as part of the present invention with reference to the timing chart shown in FIG. 4. FIG. 4 illustrates the waveforms of the control signals applied to the scanning lines WS, AZ1, AZ2 and DS along a time axis T. To simplify notation, the control signals are denoted by the same reference numerals as those for the associated scanning lines. The transistors Tr1, Tr2 and Tr3 are N-channel transistors. Therefore, these transistors are on respectively when the scanning lines WS, AZ1 and AZ2 are at high level. The transistors are off respectively when the scanning lines WS, AZ1 and AZ2 are at low level. In contrast, the transistor Tr4 is a P-channel transistor. Therefore, the transistor Tr4 is off when the scanning line DS is at high level and on when the same line DS is at low level. It should be noted that this timing chart illustrates the changes in potential of the gate G and source S of the drive transistor Trd together with the waveforms of the control signals WS, AZ1, AZ2 and DS.

In the timing chart shown in FIG. 4, the period from time T1 to T8 is defined as one field (1f). All rows of pixels in the pixel array are sequentially scanned once during one field. The timing chart illustrates the waveforms of the control signals WS, AZ1, AZ2 and DS applied to a row of pixels.

At time T0 before the field begins, all the control signals WS, AZ1, AZ2 and DS are at low level. Therefore, the N-channel transistors Tr1, Tr2 and Tr3 are off. In contrast, only the P-channel transistor Tr4 is on. Therefore, the drive transistor Trd is connected to the power source VDD via the transistor Tr4 which is on. This allows the drive transistor Trd to supply the output current Ids to the light-emitting device EL according to the given input voltage Vgs. As a result, the light-emitting device EL emits light at time T0. At this time, the input voltage Vgs applied to the drive transistor Trd is expressed by the difference between a gate potential (G) and source potential (S).

At time T1 when the field begins, the control signal DS changes from low to high level. This causes the switching transistor Tr4 to turn off, disconnecting the drive transistor Trd from the power source VDD. As a result, the light-emitting device EL stops emitting light, thus initiating a non-light emission period. As a result, when time T1 starts, all the transistors Tr1 to Tr4 are off.

Next at time T2, the control signals AZ1 and AZ2 change to high level, turning on the switching transistors Tr2 and Tr3. This connects the gate G of the drive transistor Trd to the reference potential Vss1 and the source S thereof to the reference potential Vss2. Here, the condition Vss1−Vss2>Vth is satisfied. Thus, the preparation is made for the Vth correction which will be performed later at time T3 by letting Vss1−Vss2=Vgs>Vth. In other words, the period T2-T3 corresponds to a reset period for the drive transistor Trd. Further, letting the threshold voltage of the light-emitting device EL be denoted by VthEL, VthEL>Vss2. Hence, a negative bias is applied to the light-emitting device EL, putting the same device EL in a so-called reverse bias state. This reverse bias state is required for the Vth and mobility correction operations which will be performed later.

At time T3, the control signal AZ2 change to low level. Then, immediately thereafter, the control signal DS also changes to low level. This turns off the transistor Tr3 and turns on the transistor Tr4. As a result, the drain current Ids flows into the holding capacitance Cs, thus initiating the Vth correction operation. At this time, the gate G of the drive transistor Trd is maintained at Vss1, causing the current Ids to continue to flow until the drive transistor Trd goes into cutoff. When the drive transistor Trd goes into cutoff, the source potential (S) of the same transistor Trd becomes equal to Vss1−Vth. At time T4 after the drive transistor Trd goes into cutoff, the control signal DS changes back to high level, turning off the switching transistor Tr4. Further, the control signal AZ1 changes back to low level, turning off the switching transistor Tr2. This causes Vth to be held by the holding capacitance Cs. As described above, the period T3-T4 is a period during which the threshold voltage Vth of the drive transistor Trd is detected. Here, this detection period T3-T4 is referred to as the Vth correction period.

At time T5 following the above Vth correction, the control signal WS changes to high level, turning on the sampling transistor Tr1 and writing the video signal Vsig to the holding capacitance Cs. The holding capacitance Cs is sufficiently smaller than the equivalent capacitance Coled of the light-emitting device EL. This causes the majority of the video signal Vsig to be written to the holding capacitance Cs. To be precise, the difference between Vsig and Vss1, i.e., Vsig−Vss1, is written to the holding capacitance Cs. Therefore, the voltage Vgs between the gate G and source S of the drive transistor Trd becomes equal to (Vsig−Vss1+Vth), i.e., the level obtained by adding Vth, detected earlier, to Vsig−Vss1, sampled this time. Assuming for simplification of the description that Vss1=0V, the gate-to-source voltage Vgs becomes equal to Vsig+Vth as illustrated in the timing chart of FIG. 4. The above sampling of the video signal Vsig continues until time T7 when the control signal WS changes back to low level. That is, the period T5-T7 corresponds to the sampling period (video signal write period).

At time T6 before the sampling period ends at time T7, the control signal DS changes to low level, turning on the switching transistor Tr4. This connects the drive transistor Trd to the power source VDD, causing the pixel circuit to proceed from the non-light emission period to light emission period. Thus, during the period T6-T7 when the sampling transistor Tr1 is still on and the switching transistor Tr4 has turned on, the mobility of the drive transistor Trd is corrected. That is, in the present example of the related art, the mobility correction is performed during the period T6-T7 when the later part of the sampling period and the beginning part of the light emission period coincide with each other. At the beginning of the light emission period when the mobility correction is performed, the light-emitting device EL is actually reverse-biased. Therefore, the light-emitting device EL does not emit light. During the mobility correction period T6-T7, the drain current Ids flows through the drive transistor Trd with the gate G of the same transistor Trd fixed to the level of the video signal Vsig. Here, the light-emitting device EL is placed into a reverse bias state by setting Vss1−Vth<VthEL. As a result, the same device EL exhibits a simple capacitance characteristic rather than diode characteristic. Therefore, the current Ids flowing through the drive transistor Trd is written to a capacitance C=Cs+Coled which is the sum of the holding capacitance Cs and the equivalent capacitance Coled of the light-emitting device EL. This causes the source potential (S) of the drive transistor Trd to rise. This increment is denoted by ΔV in the timing chart of FIG. 4. The increment ΔV will be eventually subtracted from the gate-to-source voltage Vgs held by the holding capacitance Cs. This means that a negative feedback is applied. Thus, a mobility μ can be corrected by negatively feeding the output current Ids of the drive transistor Trd back to the input voltage Vgs of the same transistor Trd. It should be noted that the negative feedback amount ΔV can be optimized by adjusting a time width t of the mobility correction period T6-T7.

At time T7, the control signal WS changes to low level, turning off the sampling transistor Tr1. This disconnects the gate G of the drive transistor Trd from the signal line SL. Because the video signal Vsig is removed from the gate G, the gate potential (G) of the drive transistor Trd can rise. As a result, the gate potential (G) rises together with the source potential (S). During this period, the gate-to-source voltage Vg held by the holding capacitance Cs is maintained at the level of (Vsig−ΔV+Vth). As the source potential (S) rises, the light-emitting device EL becomes no longer reverse-biased. As a result, the output current Ids begins to flow through the light-emitting device EL, thus causing the same device EL to actually start emitting light. At this time, the relationship between the drain current Ids and gate voltage Vgs is given by the formula 2 shown below by substituting Vsig−ΔV+Vth into Vgs in the transistor characteristic formula 1 given earlier.

$$Ids=k\mu(Vgs-Vth)^2=k\mu(Vsig-\Delta V)^2 \qquad \text{Formula 2}$$

In the above formula 2, k=(½)(W/L)Cox. It is clear from the formula 2 that the term of Vth is cancelled and that the output current Ids supplied to the light-emitting device EL is independent of the threshold voltage Vth of the drive transistor Trd. The drain current Ids is determined basically by the video signal voltage Vsig. In other words, the light-emitting device EL emits light at the brightness appropriate to the video signal Vsig. In this case, Vsig is corrected by the negative feedback amount ΔV. The feedback amount ΔV acts to cancel the effect of the mobility μ in the coefficient part of the formula 2. Therefore, the drain current Ids is substantially dependent only on the video signal voltage Vsig.

Finally at time T8, the control signal DS changes to high level, turning off the switching transistor Tr4. This causes the light-emitting device EL to stop emitting light and the field to end. Then, a new field begins, and the Vth and mobility corrections and light emission will be repeated again.

Figure 5:
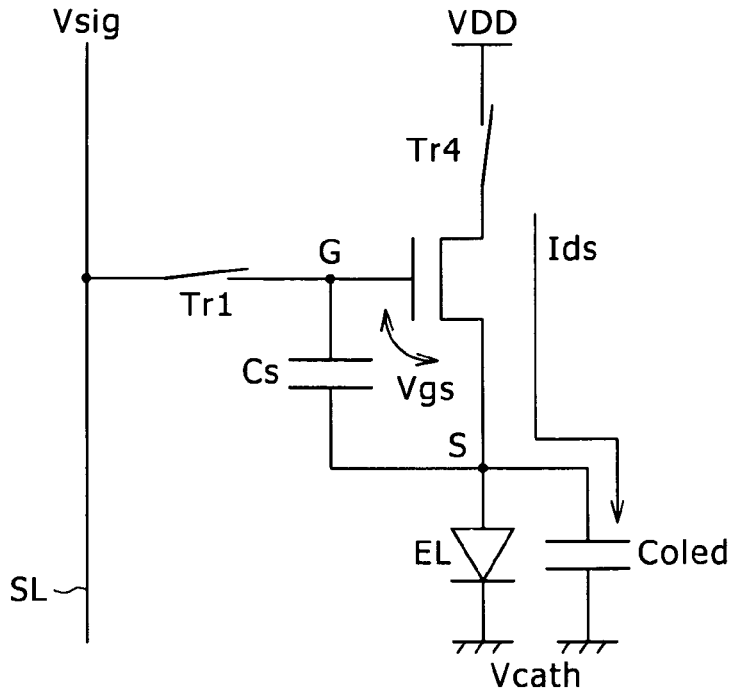
FIG. 5 is a circuit diagram similarly used for describing the operation of the display device.

FIG. 5 is a circuit diagram illustrating the condition of the pixel circuit 2 during the mobility correction period T6-T7. As illustrated in FIG. 5, during the mobility correction period T6-T7, the sampling transistor Tr1 and switching transistor Tr4 are on whereas the remaining transistors Tr2 and Tr3 are off. In this condition, the source potential (S) of the drive transistor Trd is Vss1−Vth. The source potential (S) is also the anode potential of the light-emitting device EL. As mentioned earlier, the light-emitting device EL is placed into a reverse bias state by setting Vss1−Vth<VthEL. As a result, the same device EL exhibits a simple capacitance characteristic rather than diode characteristic. Therefore, the current Ids flowing through the drive transistor Trd will flow into the combined capacitance C=Cs+Coled which is the sum of the holding capacitance Cs and equivalent capacitance Coled of the light-emitting device EL. In other words, part of the drain current Ids is negatively fed back to the holding capacitance Cs, thus correcting the mobility.

Figure 6:
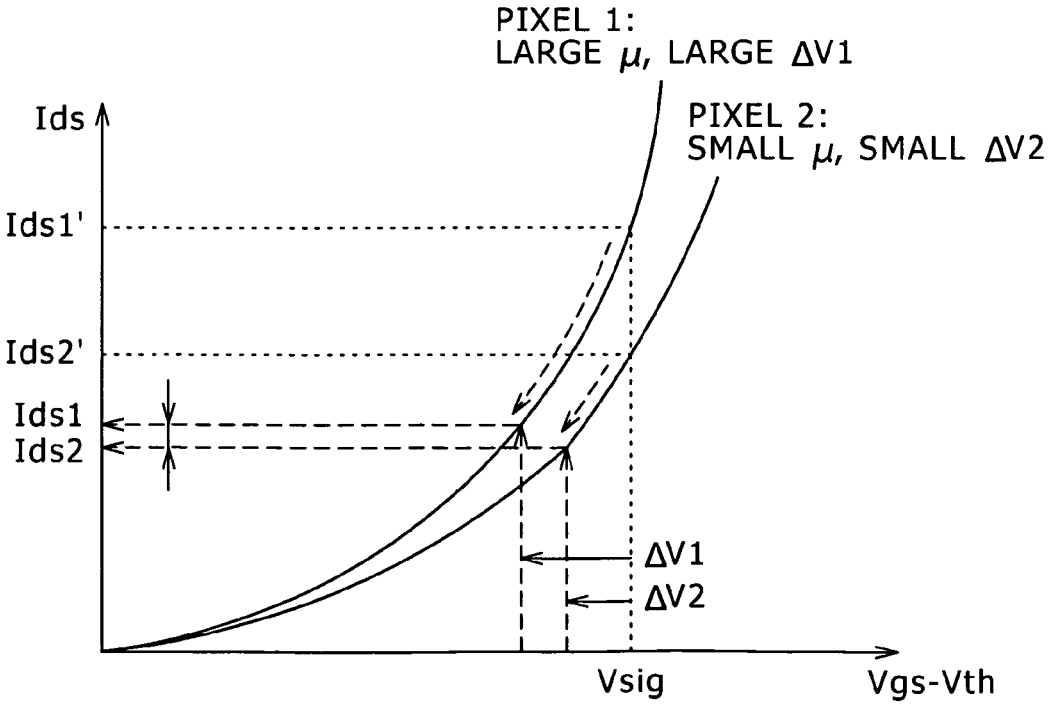
FIG. 6 is a graph similarly used for describing the operation of the display device.

FIG. 6 is a graph of the above transistor characteristic formula 2 which illustrates Ids along the vertical axis and Vsig along the horizontal axis. The characteristic formula 2 is also shown at the bottom of the graph. The graph of FIG. 6 compares the characteristic curves for pixels 1 and 2. The mobility μ of the drive transistor in the pixel 1 is relatively large. In contrast, the mobility μ of the drive transistor in the pixel 2 is relatively small. Thus, if the drive transistor includes, for example, a polysilicon thin film transistor, it is inevitable that the mobility μ varies from one pixel to another. For example, if the video signal voltage Vsig of the same level is, for example, applied to the pixels 1 and 2, there will be a large difference between a drain-to-source current Ids1' flowing through the pixel 1 with the large mobility μ and a drain-to-source current Ids2' flowing through the pixel 2 with the small mobility μ, unless the mobilities μ are corrected in one way or another. Thus, the variation in the mobility μ leads to a large difference in the output current Ids, thus resulting in banding and eventually impairing the screen uniformity.

For this reason, the related art cancels the variation in the mobility by negatively feeding the output current back to the input voltage. As is clear from the transistor formula 1, the larger the mobility becomes, the larger the drain current Ids becomes. Therefore, the larger the mobility becomes, the larger the negative feedback amount ΔV becomes. As illustrated in FIG. 6, a negative feedback amount ΔV1 of the pixel 1 with the large mobility μ is larger than a negative feedback amount ΔV2 of the pixel 2 with the small mobility μ. Therefore, the larger the mobility μ becomes, the greater the extent to which a negative feedback is applied becomes. This suppresses the variation of the mobility μ. As illustrated in FIG. 6, if the pixel 1 with the large mobility μ is corrected with the feedback amount ΔV1, the output current declines significantly from Ids1' to Ids1. On the other hand, the feedback amount ΔV2 of the pixel 2 with the small mobility μ is small. Therefore, the output current declines from Ids2' to Ids2, which is not a significant decline. As a result, Ids1 and Ids2 will become approximately equal to each other, thus canceling the variation of the mobility. The variation of the mobility is cancelled over the entire range from black to white level, thus providing extremely high screen uniformity. Summing up the above, if the pixels 1 and 2 have the different mobilities μ, the feedback amount ΔV1 of the pixel 1 with the large mobility μ is smaller than the feedback amount ΔV2 of the pixel 2 with the small mobility μ. That is, the larger the mobility becomes, the larger ΔV becomes, and the more Ids declines. As a result, the level of the pixel current can be made uniform between the pixels with the different mobilities, thus correcting the variation of the mobility.

The aforementioned mobility correction will be numerically analyzed below for reference purposes. As illustrated in FIG. 5, the analysis will be conducted by taking the source potential of the drive transistor as a variable V, with the transistors Tr1 and Tr4 left on. Letting the source potential (S) of the drive transistor Trd be denoted by V, the drain current flowing through the drive transistor Trd is as shown by the following formula 3.

$$Ids=k\mu(Vgs-Vth)^2=k\mu(Vsig-V-Vth)^2 \qquad \text{Formula 3}$$

Further, based on the relationship between the drain current Ids and capacitance C(=Cs+Coled), Ids=dQ/dt=CdV/dt holds as illustrated in the following formula 4:

$$I_{ds}=\frac{dQ}{dt}=C\frac{dV}{dt} \qquad \text{Formula 4}$$

hence $$\int\frac{1}{C}dt=\int\frac{1}{I_{ds}}dV$$

$$\Longleftrightarrow\int_0^t\frac{1}{C}dt=\int_{-Vth}^{V}\frac{1}{k\mu(V_{sig}-V_{th}-V)^2}dV$$

$$\Longleftrightarrow\frac{k\mu}{C}t=\left[\frac{1}{V_{sig}-V_{th}-V}\right]_{-Vth}^{V}=\frac{1}{V_{sig}-V_{th}-V}-\frac{1}{V_{sig}}$$

$$\Longleftrightarrow V_{sig}-V_{th}-V=\frac{1}{\frac{1}{V_{sig}}+\frac{k\mu}{C}t}=\frac{V_{sig}}{1+V_{sig}\frac{k\mu}{C}t}$$

The formula 3 is substituted into the formula 4, and then both sides of the equation are integrated. Here, the source potential V is initially −Vth. The correction time (T6-T7) for mobility variation is assumed to be t. By solving this differential equation, the pixel current with respect to the mobility correction time t is given as shown by the following formula 5:

$$I_{ds}=k\mu\left(\frac{V_{sig}}{1+V_{sig}\frac{k\mu}{C}t}\right)^2 \qquad \text{Formula 5}$$

Figure 7:
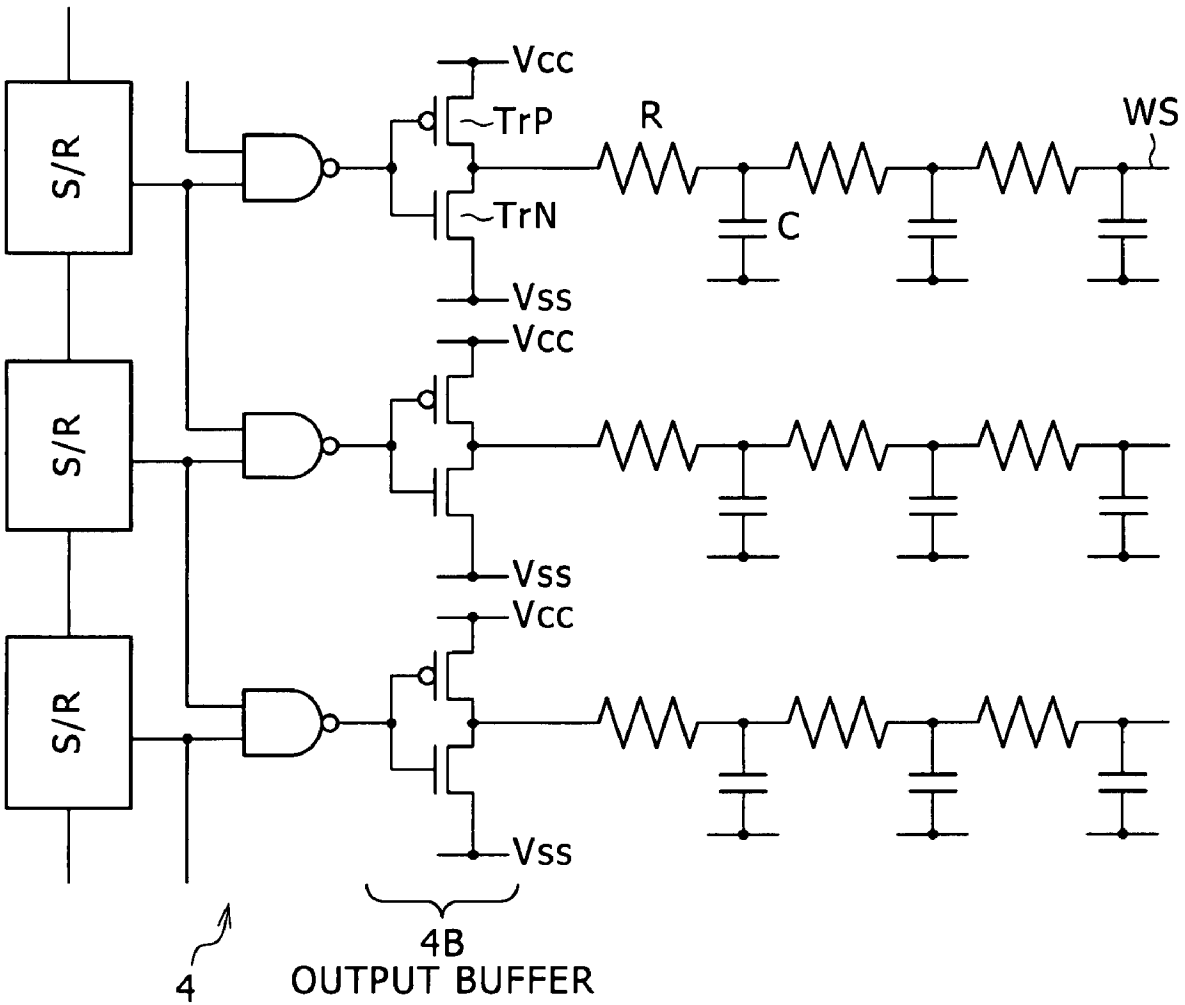
FIG. 7 is a circuit diagram illustrating a reference example of a write scanner.

As is clear from the above description, the mobility correction time t lasts from when the control signal DS falls to turn on the switching transistor Tr4 to when the control signal WS falls to turn off the sampling transistor Tr1. The mobility correction time is defined by the control signals DS and WS. The control signal WS is output by the write scanner to the scanning lines WS as described earlier. FIG. 7 is a reference diagram illustrating the typical configuration of the write scanner 4. The write scanner 4 includes a shift register S/R and operates in response to an externally fed clock signal. The same scanner 4 sequentially shifts a start signal, which is similarly fed externally, to sequentially output a signal from each of its stages. A NAND element is connected to one of the stages of the shift register S/R. The progressive signals from each pair of adjacent stages of the shift register are processed through the NAND element to generate an input signal on which the control signal WS is based. This input signal is supplied to output buffers 4B. Each of the output buffers 4B operates in response to the input signal from the shift register S/R and supplies the eventual control signal WS to the associated scanning line WS of the pixel array section. It should be noted that, in FIG. 7, the wiring resistance of each of the scanning lines WS is denoted by R, and the capacitance of the pixel connected to each of the scanning lines WS by C.

Each of the output buffers 4B includes a pair of switching elements connected in series between a source potential Vcc and ground potential Vss. In this reference example, the output buffers 4B each have an inverter configuration and include a P-channel transistor TrP as one of the switching elements and an N-channel transistor TrN as another switching element. The inverter inverts the input signal supplied from the associated stage of the shift register S/R via the NAND element and outputs the inverted signal to the associated scanning line WS as the control signal.

Figure 8:
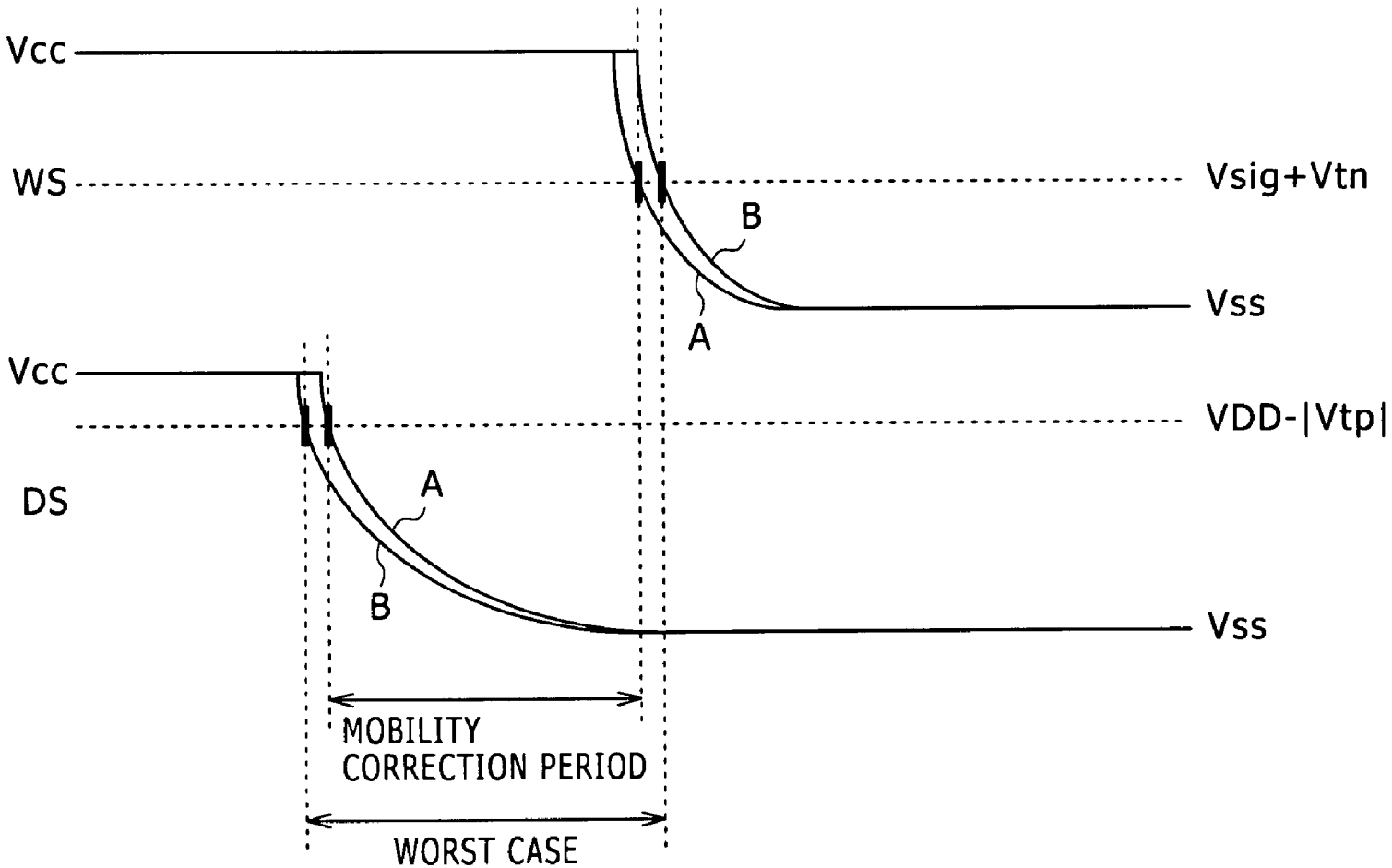
FIG. 8 is a waveform diagram used for describing the operation of the write scanner illustrated in FIG. 7.

FIG. 8 is a waveform diagram illustrating the control signal WS generated by the write scanner shown in FIG. 7. FIG. 8 also illustrates the control signal DS output from the drive scanner. It should be noted that the drive scanner DS includes a shift register and output buffers as with the write scanner WS.

As illustrated in FIG. 8, the mobility correction time begins when the control signal DS falls to turn on the P-channel switching transistor Tr4 and ends when the control signal WS falls to turn off the N-channel sampling transistor Tr1. The switching transistor Tr4 turns on when the trailing edge waveform of the control signal DS falls below VDD−|Vtp|. It should be noted that Vtp denotes the threshold voltage of the P-channel switching transistor Tr4. On the other hand, the sampling transistor Tr1 turns off when the trailing edge waveform of the control signal WS falls below Vsig+Vtn. Here, Vtn denotes the threshold voltage of the N-channel sampling transistor Tr1. The signal potential Vsig is applied to the source of the sampling transistor Tr1 from the signal line. The control signal WS is applied to the gate of the same transistor Tr1 from the control line WS. The sampling transistor Tr1 turns off when the gate potential falls below the source potential plus Vtn.

Incidentally, the trailing edge of the control signal WS differs in phase from one scanning line to another because of the manufacturing process. In FIG. 8, a trailing edge waveform B, the worst case, lags in phase relative to a trailing edge waveform A which has a standard phase. Similarly, the trailing edge waveform A of the control signal DS has a standard phase. The trailing edge waveform B, the worst case, leads in phase relative to the trailing edge waveform A. As is clear from FIG. 8, the mobility correction time is longer in the worst cases than when the trailing edge waveforms of the control signals WS and DS have a standard phase. Thus, when the write scanner and drive scanner are incorporated in the panel, the control signals WS and DS differ in phase between the scanning lines because of the manufacturing process, thus resulting in a difference in mobility correction time between the scanning lines. This manifests itself in the form of uneven horizontal brightness (banding) on the screen, thus impairing the screen uniformity.

Figure 9:
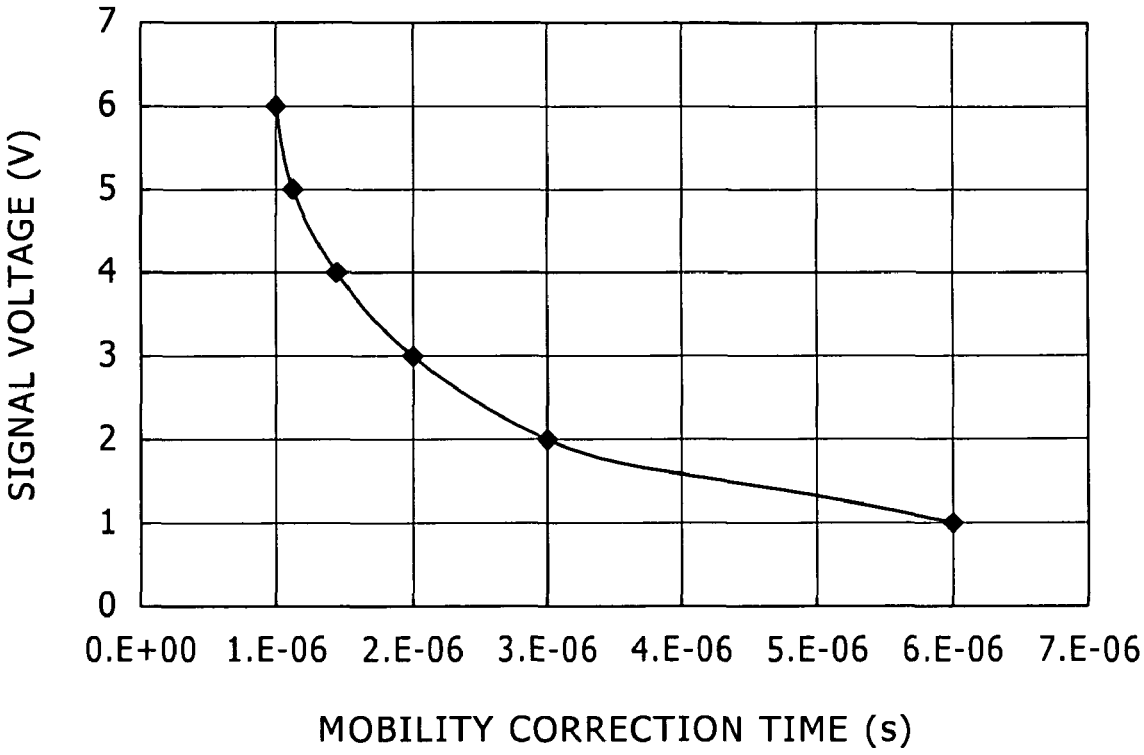
FIG. 9 is a graph used for describing the operation of a display device according to a related art.

The mobility correction has another problem in addition to the difference in correction time between the scanning lines described above. That is, the optimal mobility correction time is not always constant, but changes according to the video signal level (signal voltage). FIG. 9 illustrates a graph showing the relationship between the optimal mobility correction time and signal voltage. As is clear from FIG. 9, when the signal voltage is at white level which is high, the optimal mobility correction time is relatively short. When the signal voltage is at a gray level, the optimal mobility correction time is longer. Further, when the signal voltage is at black level, the optimal mobility correction time tends to be even longer. As mentioned earlier, the correction amount ΔV to be negatively fed back to the holding capacitance is proportional to the signal voltage Vsig during the mobility correction period. The higher the signal voltage becomes, the larger the negative feedback amount becomes. As a result, the optimal mobility correction time tends to be shorter. In contrast, the lower the signal voltage becomes, the less current the drive transistor can supply. As a result, the optimal mobility correction time required for ample correction tends to become longer.

For this reason, a related art is available which automatically adjusts the timing at which the sampling transistor Tr1 turns off so that the correction time t is short when the video signal voltage Vsig supplied to the signal line SL is high and so that the correction time t is long when the same voltage Vsig is low. The operating principle thereof is illustrated in FIG. 10.

Figure 10:
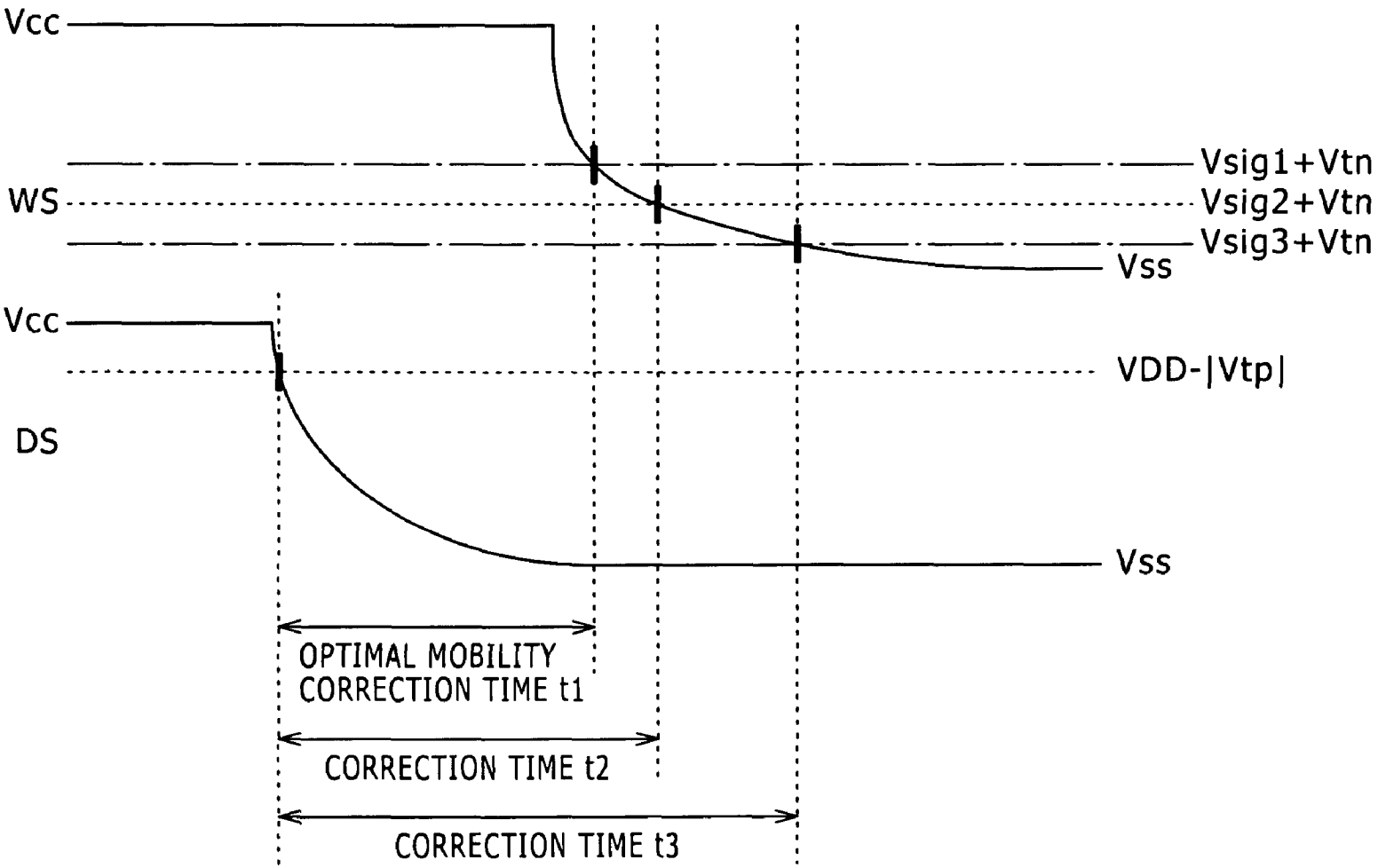
FIG. 10 is a waveform diagram similarly used for describing the operation of the display device.

The waveform diagram of FIG. 10 shows the trailing edge waveforms of the control signals DS and WS adapted to determine the timings at which the switching transistor Tr4 turns on and the sampling transistor Tr1 turns off. The transistors Tr4 and Tr1 define the mobility correction period t. As mentioned earlier, the switching transistor Tr4 turns on when the control signal applied to the gate of the same transistor Tr4 falls below VDD−|Vtp|, thus initiating the mobility correction time.

On the other hand, the control signal WS is applied to the gate of the sampling transistor Tr1. The control signal WS declines sharply from the source potential Vcc at first. Then, the signal falls slowly to the ground potential Vss. Here, if a signal potential Vsig1 applied to the source of the sampling transistor Tr1 is at white level which is high, the gate potential of the same transistor Tr1 falls quickly to Vsig1+Vtn. Therefore, an optimal mobility correction time t1 is short. If the signal potential is Vsig2 at a gray level, the sampling transistor Tr1 turns off when the gate potential falls from Vcc to Vsig2+Vtn. As a result, an optimal mobility correction time t2 associated with Vsig2 for the gray level is longer than the time t1. Further, if the signal potential is Vsig3 close to black level, an optimal mobility correction time t3 is even longer than the optimal mobility correction time t2 for the gray level.

Figure 11:
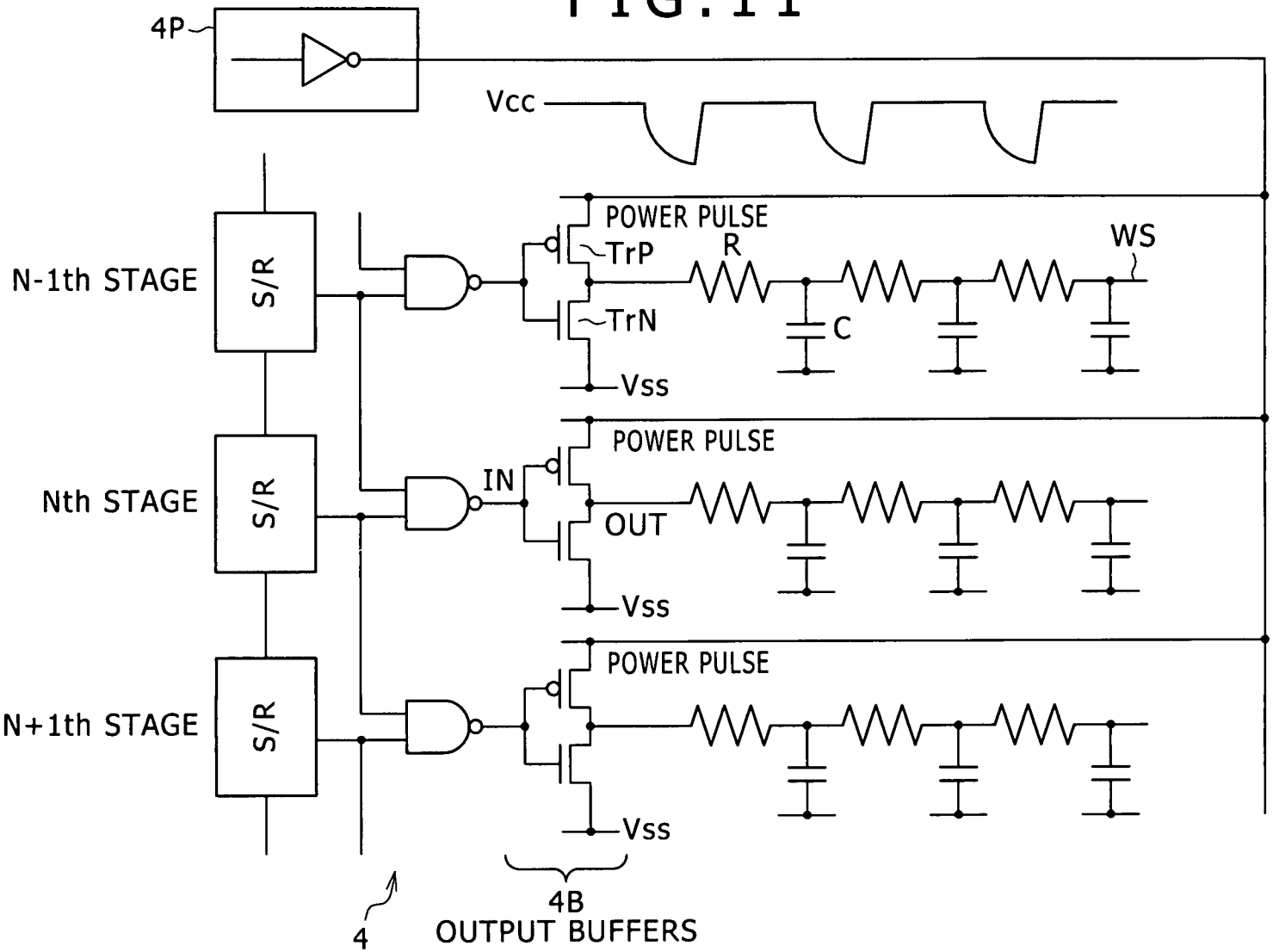
FIG. 11 is a circuit diagram similarly illustrating the configuration of the write scanner incorporated in the display device according to the related art.

To automatically set an optimal mobility correction time for each of the gray levels, the trailing edge of the control signal pulse applied to the scanning line WS needs to be shaped into an optimal waveform. To accomplish this, the related art employs a write scanner adapted to extract a power pulse supplied from an external module (pulse generator). This write scanner will be described with reference to FIG. 11. It should be noted that the external power pulse module can stably supply a pulse waveform, thus simultaneously resolving the problem of difference in phase of the trailing edge waveform of the control signal mentioned earlier. FIG. 11 schematically illustrates three stages (N−1th, Nth and N+1th stages) of the output section of the write scanner 4 and three rows (three lines) of the pixel array section 1 connected to the three stages. It should be noted that, for easier understanding, the same reference numerals are used to denote like components of the write scanner according to the reference example shown in FIG. 7.

The write scanner 4 includes the shift register S/R and operates in response to an externally fed clock signal. The same scanner 4 sequentially shifts a start signal, which is similarly fed externally, to sequentially output a signal from each of its stages. A NAND element is connected to one of the stages of the shift register S/R. The progressive signals from each pair of adjacent stages of the shift register are processed through the NAND element to generate a rectangular input signal IN on which the control signal WS is based. This rectangular waveform is fed to the output buffers 4B via an inverter. Each of the output buffers 4B operates in response to the input signal IN from the shift register S/R and supplies the eventual control signal WS to the associated scanning line WS of the pixel array section 1 as an output signal OUT.

Each of the output buffers 4B includes a pair of switching elements connected in series between the source potential Vcc and ground potential Vss. In the present embodiment, the output buffers 4B each have an inverter configuration and include the P-channel transistor TrP (typically a PMOS transistor) as one of the switching elements and the N-channel transistor TrN (typically an NMOS transistor) as another switching element. It should be noted that each line of the pixel array section 1 connected to one of the output buffers 4B is denoted by a resistive component R and capacitive component C in the same way as in an equivalent circuit.

In the present embodiment, each of the output buffers 4B extracts a power pulse supplied to the power line from an external pulse module 4P to generate the final waveform of the control signal WS. As described earlier, the output buffers 4B each have an inverter configuration and include the P-channel transistor TrP and N-channel transistor TrN connected in series between the power line and ground potential Vss. When the P-channel transistor TrP turns on in response to the input signal IN from the shift register S/R, the output buffer 4B extracts the trailing edge waveform of the power pulse supplied to the power line and supplies this waveform to the pixel array section 1 as the final waveform of the control signal WS. Thus, a pulse containing the final waveform is generated by the external module 4P separately from the output buffers 4B. Then, this pulse is supplied to the power line of the output buffers 4B. As a result, the control signal WS having the desired final waveform can be generated. In this case, each of the output buffers 4B extracts the trailing edge waveform of the externally supplied power pulse and outputs the waveform as the final waveform OUT of the control signal WS when the P-channel transistor TrP serving as a superior switching element turns on and the N-channel transistor TrN serving as an inferior switching element turns off.

Figure 12:
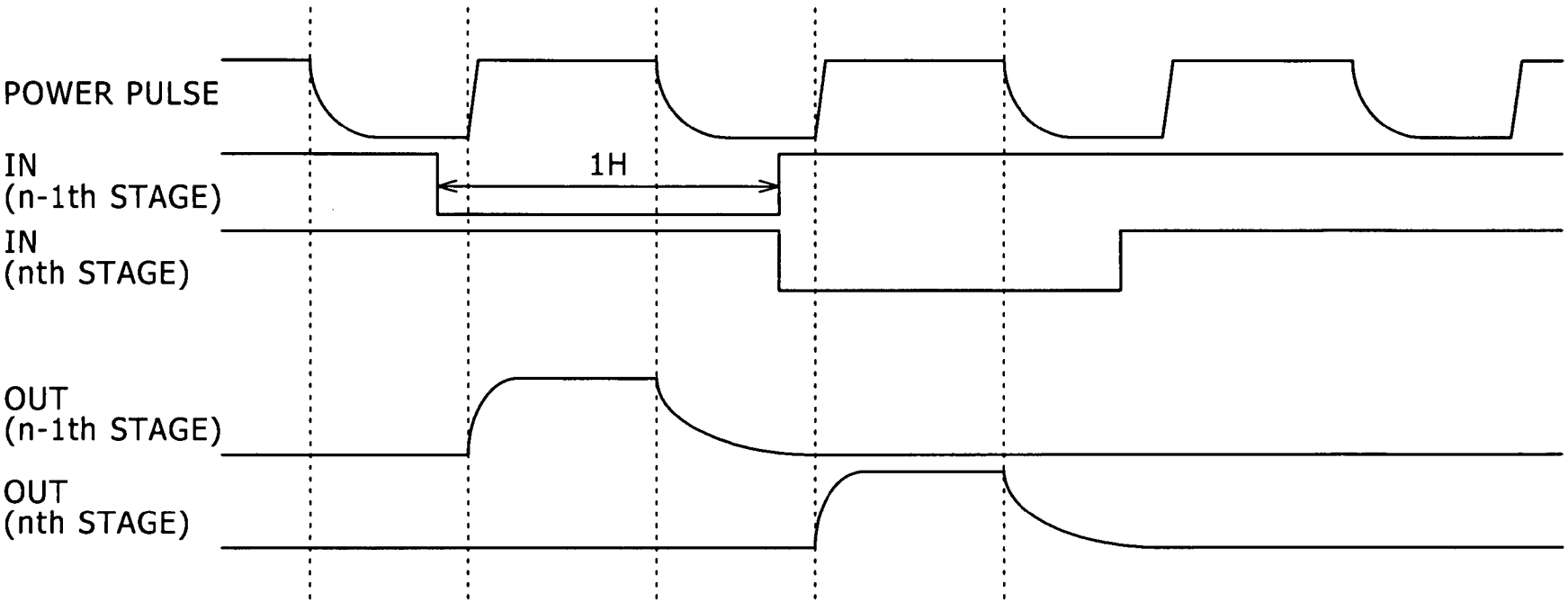
FIG. 12 is a waveform diagram used for describing the operation of the write scanner illustrated in FIG. 11.

FIG. 12 is a timing chart used for describing the operation of the write scanner shown in FIG. 11. As illustrated in FIG. 12, a power pulse train whose change in level occurs every 1H is fed to the power line of the output buffer from the external module. At the same time, the input pulse IN is applied to the inverter making up the output buffer. The timing chart illustrates the input pulses IN supplied to the inverters at the n−1th and nth stages. The timing chart also illustrates the output pulses OUT supplied from the n−1th and nth stages in the same time series. Each of the output pulses OUT is a control signal applied to the associated scanning line WS.

As is clear from the timing chart, the output buffer at each stage of the write scanner extracts the power pulse in response to the input pulse IN and supplies the pulse to the associated scanning line WS in an as-is form as the output pulse OUT. The power pulse is supplied from the external module. The trailing edge waveform thereof can be optimally set in advance. The write scanner extracts this trailing edge waveform in an as-is form for use as the control signal pulse.

However, the module of the write scanner according to the related art illustrated in FIG. 11 needs to generate the power pulse every 1H. In addition, the load of all the stages is connected to the wiring which supplies the power pulse to the pixel array section, resulting in an extremely high wiring capacitance. This leads to a large power consumption of the external module adapted to supply the power pulse. On the other hand, a stable pulse transient needs to be secured to control the mobility correction time. However, the capability of the pulse module needs to be enhanced to achieve this goal. This has resulted in a larger module area. In order for the display device to find application as a display of mobile equipment, reduced power consumption is particularly sought after in the display device. It is becoming increasingly difficult for the scanner using an external module as illustrated in FIG. 11 to meet this requirement.

Figure 13:
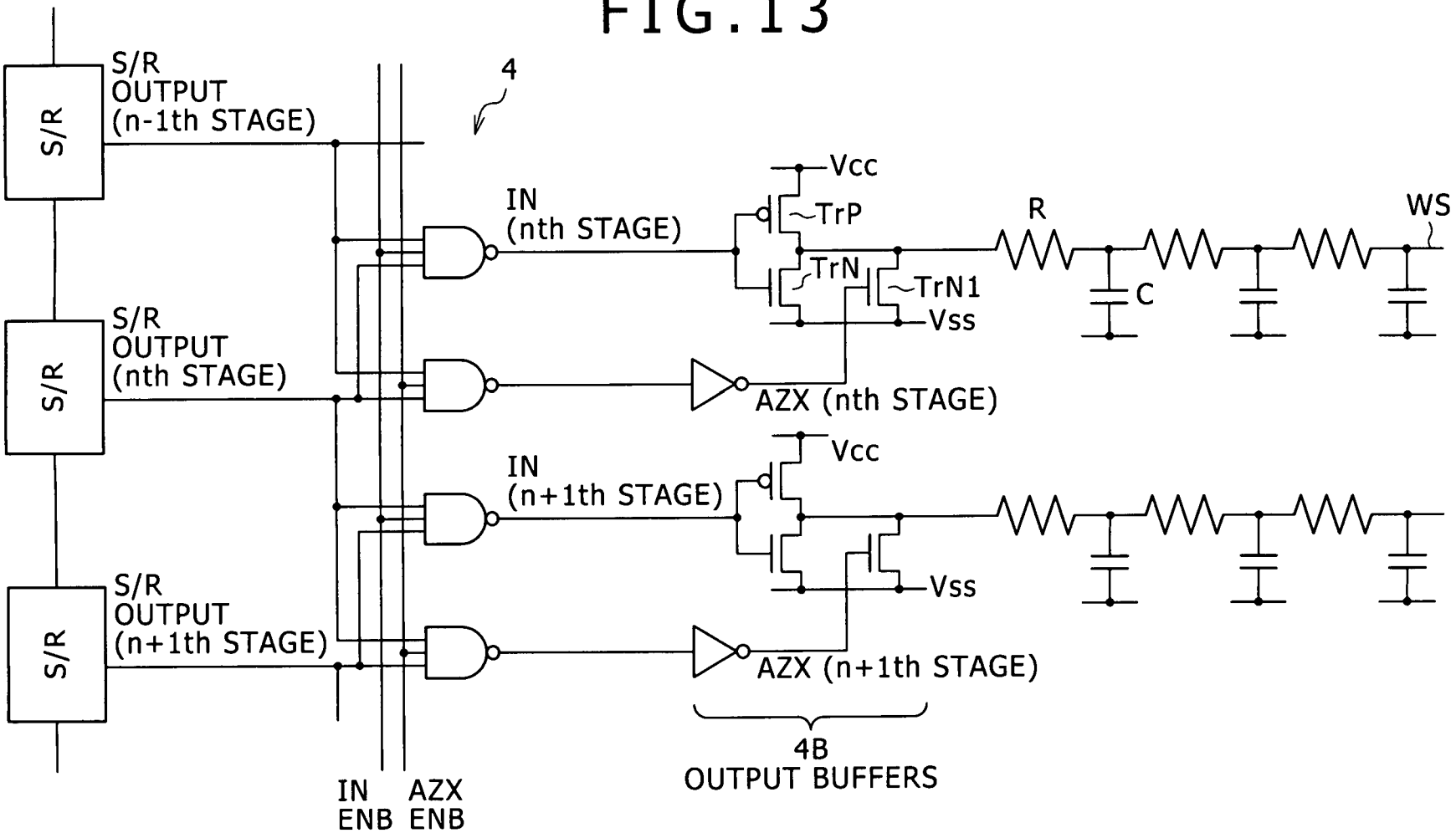
FIG. 13 is a circuit diagram illustrating a first embodiment of the write scanner incorporated in the display device according to an embodiment of the present invention.

FIG. 13 is a circuit diagram illustrating the configuration of the write scanner serving as one of the major components of the display device according to an embodiment of the present invention. The present write scanner has been designed to address the problems with the write scanner according to the related art. The present write scanner is constructed so that it can internally generate a trailing edge waveform of the control signal WS adapted to define the mobility correction time. For easier understanding, the same reference numerals are used to denote like components of the write scanner according to the related art shown in FIG. 11. The present write scanner internally generates a trailing edge waveform of the control signal required to control the mobility correction time. This eliminates the need for any external module adapted to supply a power pulse, thus providing low power consumption, low cost and miniaturization. This makes the display device ideal for use as a monitor of mobile equipment.

As illustrated in FIG. 13, the present write scanner 4 includes the shift register S/R and output buffers 4B. The shift register S/R sequentially generates the input signal IN from each of its stages in synchronism with line-sequentially scanning. More specifically, a NAND element is connected to one of the stages of the shift register S/R. The input signal IN is supplied to the output buffer 4B at each stage via this NAND element. In FIG. 13, the input signals IN at the nth and n+1th stages are shown. It should be noted that an additional NAND element is connected to one of the stages of the shift register S/R. An additional input signal AZX is supplied to the output buffer 4B from this additional NAND element. In FIG. 13, the input signals AZX at the nth and n+1th stages are shown. As is clear from the above description, a pair of the NAND elements are provided to be associated with each stage of the shift register S/R. A pair of the input signals IN and AZX are supplied to the output buffer 4B at the associated stage from the NAND element pair. It should be noted that, in addition to the pulses from the shift register S/R, control pulses INENB and AZXENB are also supplied externally to each NAND element pair. In the present specification, these NAND elements are treated as components making up part of the shift register.

Each of the output buffers 4B is connected between one of the stages of the shift register S/R and one of the scanning lines WS and outputs the control signal WS to the associated scanning line WS in response to the input signals IN and AZX. At this time, each of the output buffers 4B varies the trailing edge waveform of the control signal WS at least in two steps in response to the input signals IN and AZX, thus variably controlling the mobility correction period t according to the video signal level. The control signal WS defines the timing at which the sampling transistor Tr1 turns off.

In a more specific configuration, the output buffer 4B at each stage includes an inverter. The inverter includes the P-channel TrP and N-channel transistor TrN connected in series between the source line Vcc and ground line Vss. The output buffer 4B at each stage further includes at least one additional N-channel transistor TrN1 connected in parallel with the N-channel transistor TrN. Each of the output buffers 4B controls the on/off operations of the N-channel transistors TrN and TrN1 in response to the input signals IN and AZX to vary the trailing edge waveform of the control signal WS at least in two steps. The shift register S/R adjusts the phases of the input signals IN and AZX to adjust the on/off timings of the N-channel transistors TrN and TrN1, thus optimizing the trailing edge waveform of the control signal WS. Preferably, the N-channel transistors TrN and TrN1 of the output buffer 4B should be adjusted in size in advance to optimize the trailing edge waveform of the control signal.

As is clear from the above description, the output buffers of the embodiment shown in FIG. 13 each include the plurality of N-channel transistors and turn on and off these transistors TrN and TrN1 in sequence, thus controlling the trailing edge waveform of the control signal WS adapted to determine the mobility correction time. The same input signal IN is supplied to the P-channel transistor TrP and N-channel transistor TrN. The other input signal AZX is supplied to the other N-channel transistor TrN1. Further, the transistor TrN has a greater channel wider than the transistor TrN1.

Figure 14:
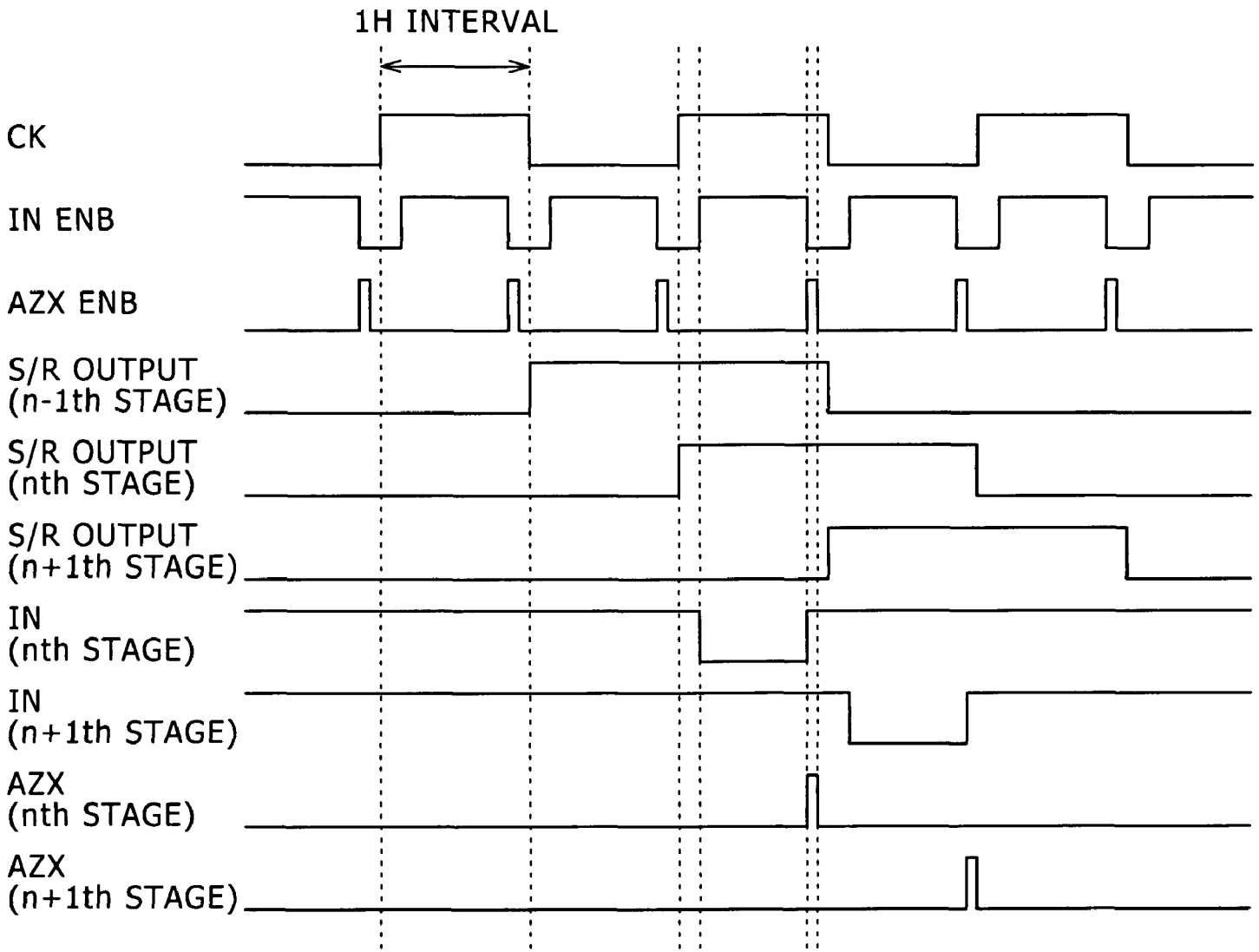
FIG. 14 is a timing chart used for describing the operation of the first embodiment.

FIG. 14 is a timing chart used for describing the operation of the write scanner shown in FIG. 13. A clock signal CK is fed to the shift register S/R to control the operation thereof. The clock signal CK defines the 1H interval. The write scanner basically performs line-sequentially scanning every 1H in response to the clock signal CK to supply the control signal WS to each of the scanning lines WS. The pulses INENB and AZXENB adapted to control the NAND elements are also supplied externally in step with the clock pulse CK. The timing chart illustrates the signals output from each of the stages (n−1th, nth and n+1th stages) of the shift register S/R in synchronism with the signals CK, INENB and AZXENB. The timing chart also illustrates the input signals IN and AZX at the nth and n+1th stages.

As is clear from the timing chart, each stage of the shift register S/R supplies the input signals IN and AZX to the output buffer at the associated stage in response to the externally supplied clock signal CK and enable signals INENB and AZXENB. The output buffer at each stage outputs the control signal WS to the associated scanning line WS. The trailing edge waveform of the control signal WS varies at least in two steps in response to the input signals IN and AZX.

Figure 15A:
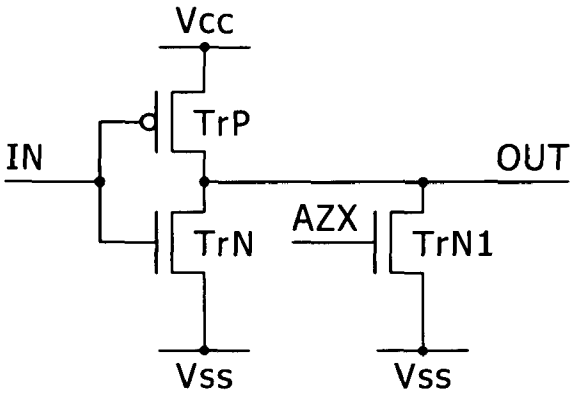
FIG. 15A and FIG. 15B are a circuit diagram and timing chart similarly used for describing the operation of the first embodiment.
Figure 15B:
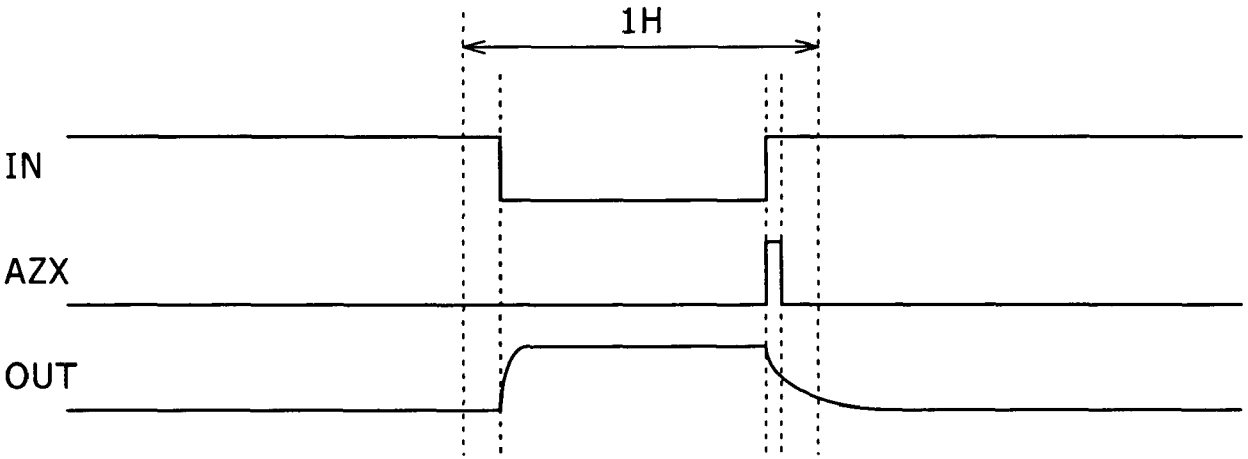

A detailed description will be given below of the operation of a first embodiment of the write scanner according to an embodiment of the present invention shown in FIG. 13 with reference to FIGS. 15A to 19B. FIG. 15A and FIG. 15B include a circuit diagram illustrating the output buffer at one of the stages and a timing chart illustrating the waveforms of the input and output signals fed to and output from the output buffer. As mentioned earlier, the output buffer includes the P-channel transistor TrP, N-channel transistor TrN and additional N-channel transistor TrN1. The input signals IN and AZX are supplied from the shift register to the output buffer configured as described above. The output signal OUT is supplied from the output buffer to the associated scanning line as the control signal WS.

Figure 16A:
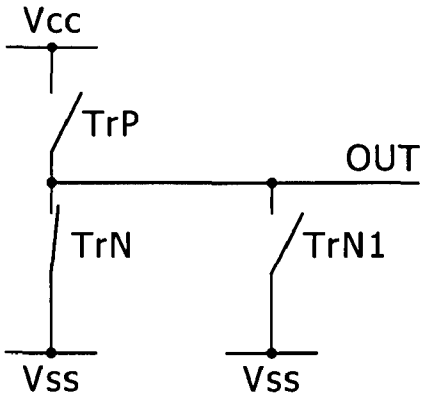
FIG. 16A and FIG. 16B are a circuit diagram and timing chart similarly used for describing the operation of the first embodiment.
Figure 16B:
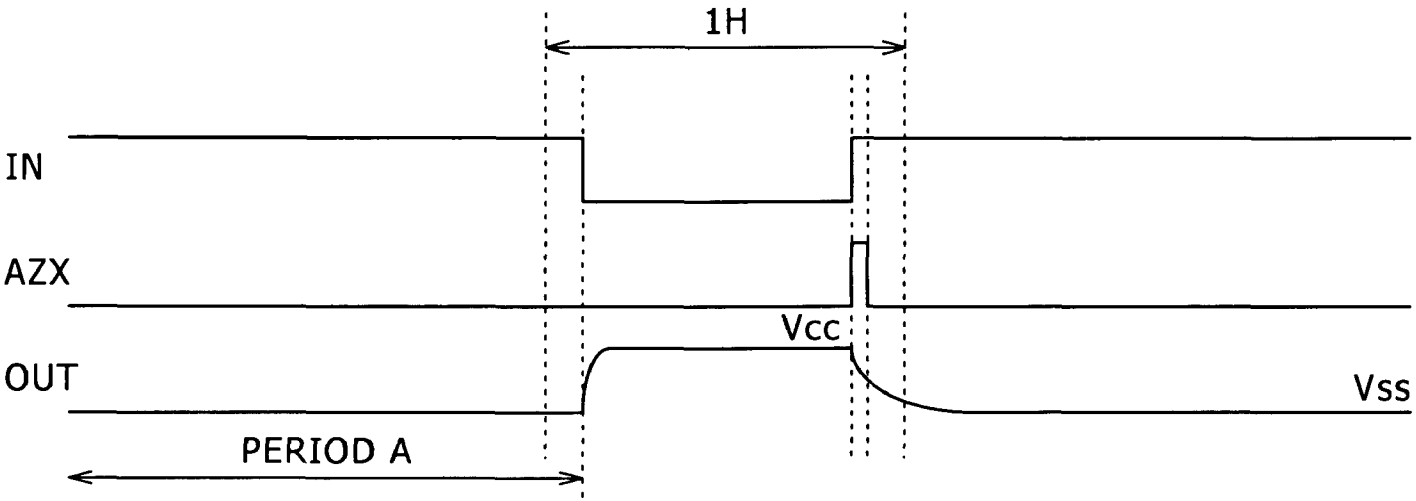

FIG. 16A and FIG. 16B illustrates the operating condition of the output buffer during a period A. During the period A, the input signal IN is at high level, and the input signal AZX is at low level. At this time, the transistors TrP and TrN1 are off, and the transistor TrN is on. Therefore, the output OUT of the output buffer is at the ground level Vss.

Figure 17A:
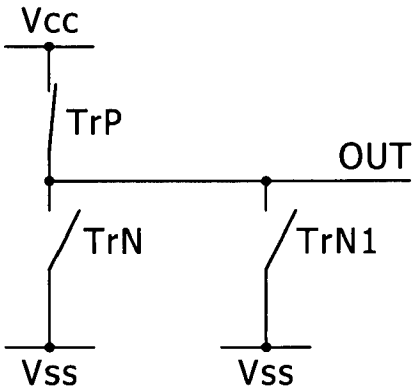
FIG. 17A and FIG. 17B are a circuit diagram and timing chart similarly used for describing the operation of the first embodiment.
Figure 17B:
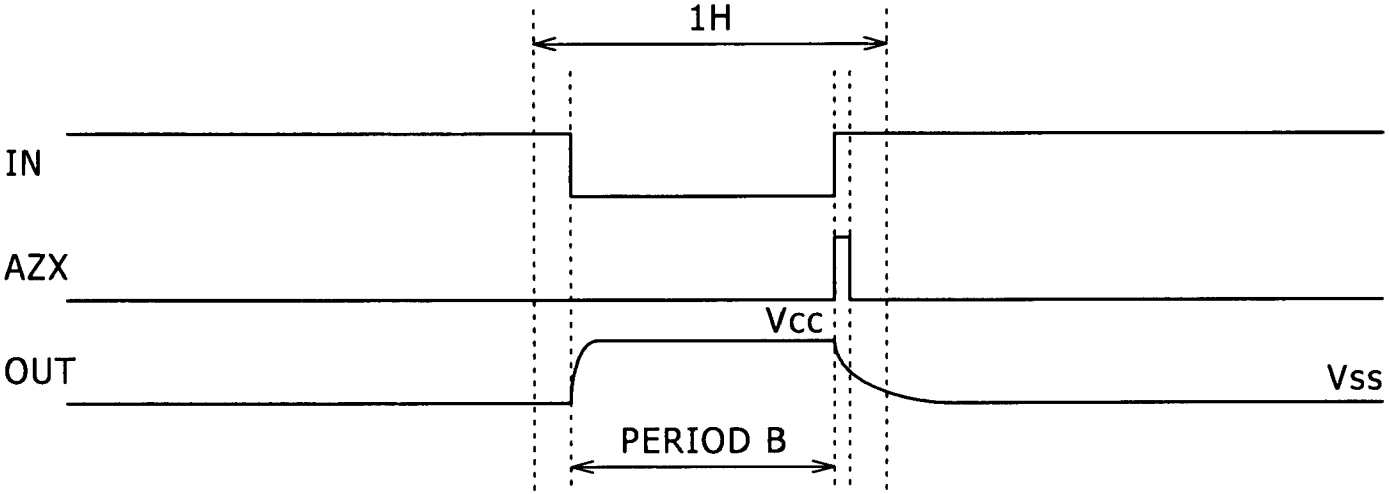

FIG. 17A and FIG. 17B illustrate the operating condition of the output buffer during a period B. When the period B begins, the input signal IN changes to low level, turning off the transistors TrN and TrN1 and turning on the TrP. As a result, the output OUT changes to Vcc. This turns on the sampling transistor Tr1, sampling the signal voltage from the signal line and writing the sampled voltage to the holding capacitance.

Figure 18A:
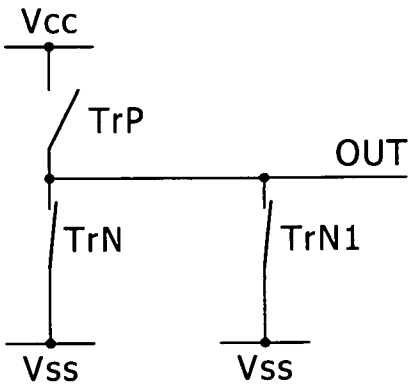
FIG. 18A and FIG. 18B are a circuit diagram and timing chart similarly used for describing the operation of the first embodiment.
Figure 18B:
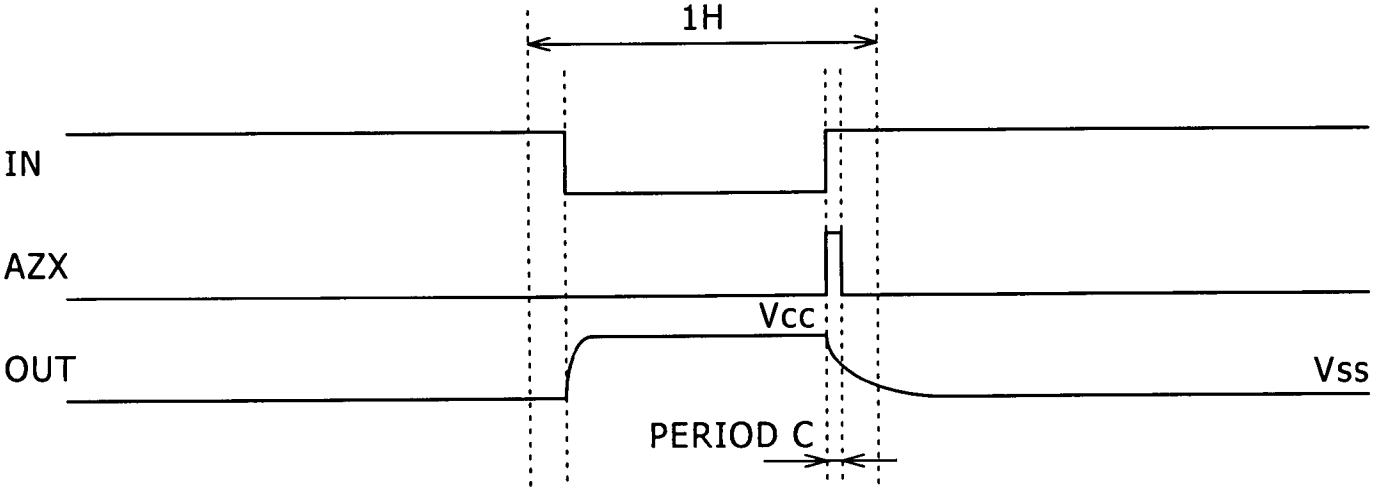

FIG. 18A and FIG. 18B illustrate the operating condition of the output buffer during a period C. During the period C, the input signal IN changes to high level, and the input signal AZX remains at high level. This turns off the transistor TrP and turns on the TrN and TrN1 at the same time. As a result, the output OUT begins to decay to Vss. The current level flowing at this moment is the sum of the current levels flowing through the transistors TrN and TrN1. Here, letting the transistor factors of the transistors TrN and TrN1 be denoted respectively by k and k', the current Ids is expressed by the formula 6 shown below. The output waveform OUT falls in proportion to the total current Ids, thus resulting in a sharp falling pulse transient. It should be noted that the transistor factor K corresponds to (1/2)(W/L)Cox in the formula 1.

$$Ids=(k+k')\mu(Vgs-Vth)^2 \quad \text{Formula 6}$$

Figure 19A:
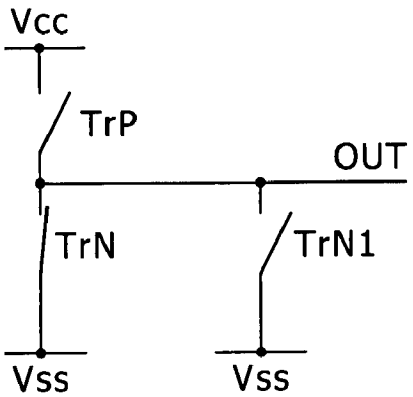
FIG. 19A and FIG. 19B are a circuit diagram and timing chart similarly used for describing the operation of the first embodiment.
Figure 19B:
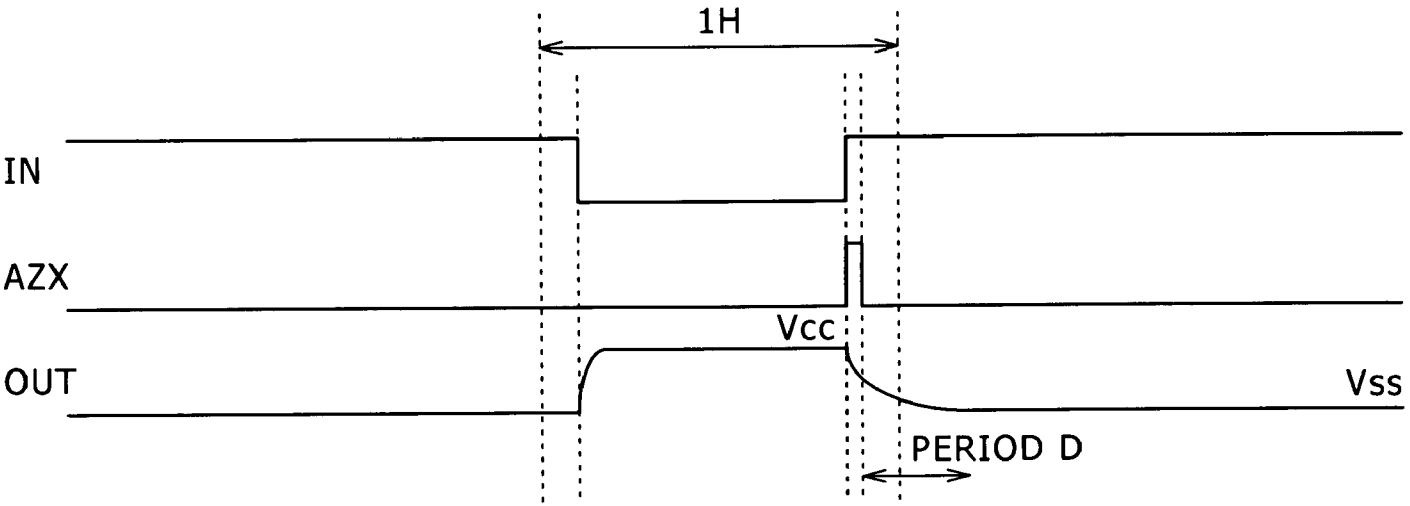

FIG. 19A and FIG. 19B illustrate the operating condition of the output buffer during a period D. During the period D, the input signal IN remains at high level, and the input signal AZX changes back to low level. This turns off the transistor TrN1. From this moment onward, only the transistor TrN remains on. As a result, the trailing edge waveform is determined solely by the N-channel transistor TrN. Here, the transistor TrN has a smaller channel width than the transistor TrN1. Therefore, the current level Ids flowing therethrough is small. This provides a slow falling pulse transient of the output OUT.

$$Ids=k\mu(Vgs-Vth)^2 \quad \text{Formula 7}$$

As described above, the operations illustrated in FIGS. 16A to 19B make it possible to variably control the output pulse waveform in a step-by-step manner. As a result, a correction pulse can be generated which is best suited to the mobility correction period for each gray level, thus providing a high screen uniformity. Further, the present invention eliminates the need for any external module adapted to supply a power pulse, thus providing low power consumption. Still further, the module area can be significantly reduced if the panel incorporates the function to generate the control signals.

Figure 20A:
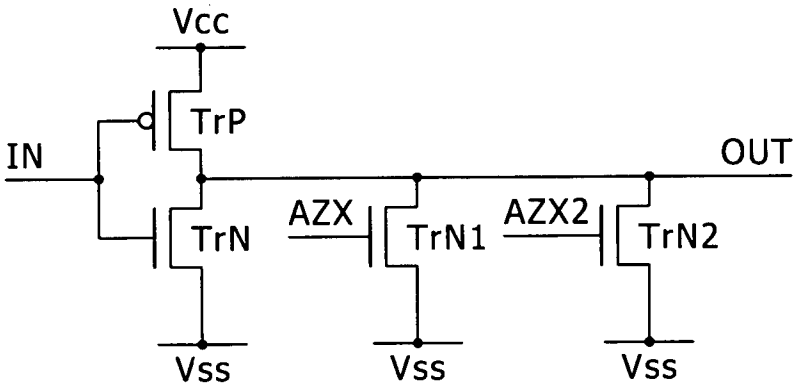
FIG. 20A and FIG. 20B are a circuit diagram and waveform diagram illustrating a second embodiment of the write scanner incorporated in the display device according to an embodiment of the present invention.
Figure 20B:
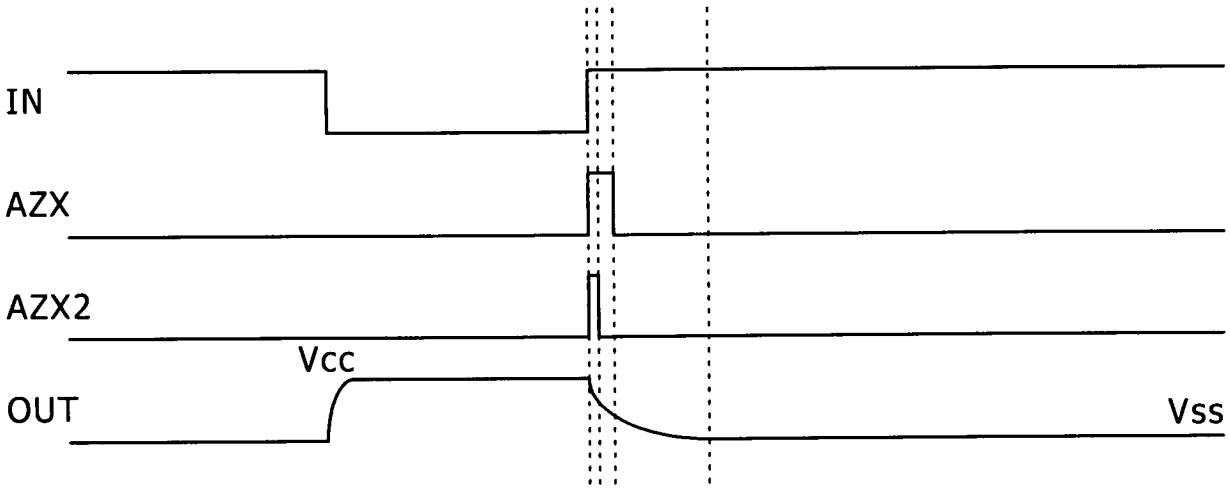

FIG. 20A is a circuit diagram illustrating a second embodiment of the write scanner incorporated in the display device according to an embodiment of the present invention and a timing chart of the same. For easier understanding, the same reference numerals are used to denote like components of the write scanner according to the first embodiment shown in FIG. 15A and FIG. 15B. The second embodiment differs from the first embodiment in that a third N-channel transistor TrN2 is connected between the output terminal of the output buffer and the ground line Vss. As a result, a third input signal AZX2 is supplied from the shift register to the gate of the N-channel transistor TrN2.

As illustrated in the timing chart, the waveform transient of the output OUT can be more accurately formed than in the first embodiment by controlling, in sequence, the on/off operations of the three N-channel transistors TrN, TrN1 and TrN2 which are contained in the output buffer. For example, the current Ids flowing at the initial stage of the trailing edge of the output OUT is expressed by the formula 8 shown below. Thus, the mobility correction time tailored to the input level of the video signal can be provided by controlling the trailing edge waveform of the output OUT in three steps.

$$Ids=(k+k'+k'')\mu(Vgs-Vth)^2 \quad \text{Formula 8}$$

Figure 21:
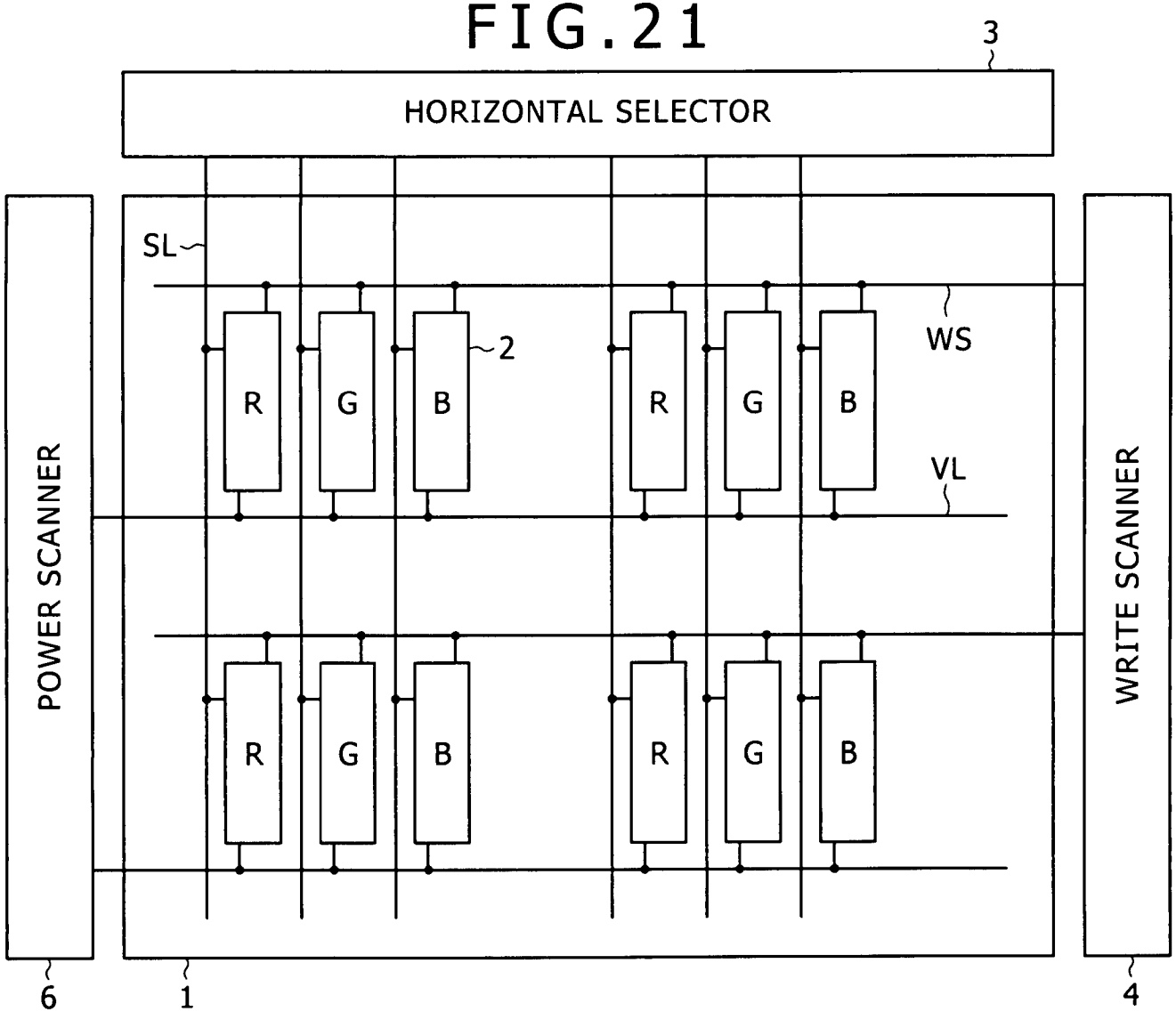
FIG. 21 is a block diagram illustrating the overall configuration of a third embodiment of the display device according to an embodiment of the present invention.

FIG. 21 is a block diagram illustrating the overall configuration of a third embodiment of the display device according to an embodiment of the present invention. The present display device includes the pixel array section 1 and a driving section adapted to drive the same section 1. The pixel array section 1 includes the scanning lines WS arranged in rows and signal lines SL arranged in columns. The same section 1 further includes the pixels 2 arranged in a matrix. Each of the pixels 2 is disposed at the intersection of the scanning line WS and signal line SL. The same section 1 still further includes power feed lines (power lines) VL, each disposed to be associated with one of the rows of the pixels 2. It should be noted that, in the present example, one of the three primary colors of RGB is assigned to each of the pixels 2 to display a color image. It should be noted, however, that the present invention is not limited to the above, but the pixel 2 may also include a device adapted to display a monochrome image. The driving section includes the write scanner 4 adapted to sequentially supply a control signal to each of the scanning lines WS and progressively scan the pixels 2 on a row-by-row basis. The driving section further includes a power scanner 6 adapted to supply a source voltage to each of the power feed lines VL in step with the line-sequentially scanning. The source voltage changes between first and second potentials. The driving section still further includes the signal selector (horizontal selector) 3 adapted to supply signal and reference potentials to the signal lines SL arranged in column in step with the line-sequentially scanning. The signal potential serves as a video signal.

Figure 22:
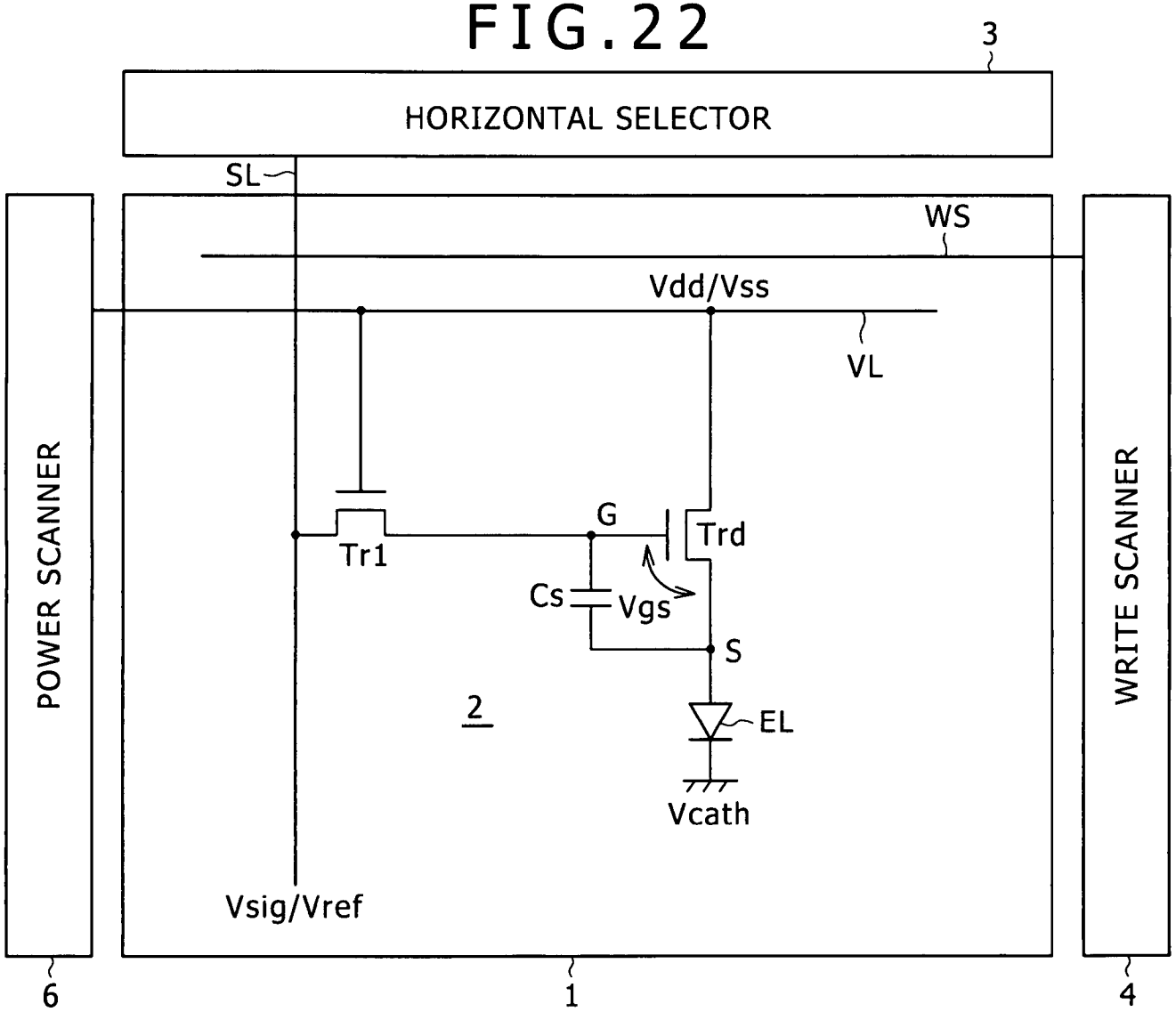
FIG. 22 is a circuit diagram illustrating the configuration of the pixel incorporated in the display device illustrated in FIG. 21.

FIG. 22 is a circuit diagram illustrating a specific configuration of the pixel 2 incorporated in the display device shown in FIG. 21. As illustrated in FIG. 22, the pixel 2 includes the light-emitting device EL as typified by an organic EL device. The pixel 2 further includes the sampling transistor Tr1, drive transistor Trd and holding capacitance Cs. The sampling transistor Tr1 has its control terminal (gate) connected to the associated scanning line WS. The same transistor Tr1 has one of its pair of current terminals (source and drain) connected to the associated signal line SL and the other of its pair of current terminals connected to the control terminal (gate G) of the drive transistor Trd. The drive transistor Trd has one of its pair of current terminals (source and drain) connected to the light-emitting device EL and the other of its pair of current terminals connected to the associated power feed line VL. In the present example, the drive transistor Trd is an N-channel transistor. The same transistor Trd has its drain connected to the power feed line VL and its source S connected to the anode of the light-emitting device EL as the output node. The light-emitting device EL has its cathode connected to a given cathode potential Vcath. The holding capacitance Cs is connected between the source S and gate G of the drive transistor Trd.

In the above configuration, the sampling transistor Tr1 conducts in response to a control signal from the scanning line WS to sample the signal potential from the signal line SL and hold the sampled potential in the holding capacitance Cs. The drive transistor Trd is supplied with a current from the power feed line VL at the first potential (high potential Vdd), thus causing a drive current, appropriate to the signal potential held by the holding capacitance Cs, to flow through the light-emitting device EL. In order to bring the sampling transistor Tr1 into conduction during a time period when the signal line SL is at the signal potential, the write scanner 4 outputs a control signal of a given pulse width to the control line WS, thus holding the signal potential in the holding capacitance Cs and applying the correction of the mobility μ of the drive transistor Trd to the signal potential. Thereafter, the drive transistor Trd supplies a drive current, appropriate to the signal potential Vsig written to the holding capacitance Cs, to the light-emitting device EL, thus initiating the light emission.

The present pixel circuit 2 has not only the above mobility correction function but also the threshold voltage correction function. That is, before the sampling transistor Tr1 samples the signal potential Vsig, the power scanner 6 changes the power feed line VL from the first potential (high potential Vdd) to the second potential (low potential Vss) at the first timing. Further, similarly before the sampling transistor Tr1 samples the signal potential Vsig, the write scanner 4 brings the sampling transistor Tr1 into conduction at the second timing, thus applying a reference potential Vref to the gate G of the drive transistor Trd from the signal line SL and setting the source S of the drive transistor Trd to the second potential (Vss) at the same time. The power scanner 6 changes the power feed line VL from the second potential Vss to the first potential Vdd at the third timing following the second timing, thus holding the voltage corresponding to the threshold voltage Vth of the drive transistor Trd in the holding capacitance Cs. Thanks to the threshold voltage correction function, the present display device can cancel the impact of the threshold voltage Vth of the drive transistor Trd which varies from one pixel to another.

The present pixel circuit 2 further has the bootstrapping function. That is, the write scanner 4 removes the control signal from the scanning line when the signal potential Vsig is held by the holding capacitance Cs, thus bringing the sampling transistor Tr1 out of conduction and electrically disconnecting the gate G of the drive transistor Trd from the signal line SL. As a result, the gate G of the drive transistor Trd varies in potential with variation in the potential of the source S of the same transistor Trd. This makes it possible to maintain constant the voltage Vgs between the gate G and source S of the same transistor Trd.

Figure 23:
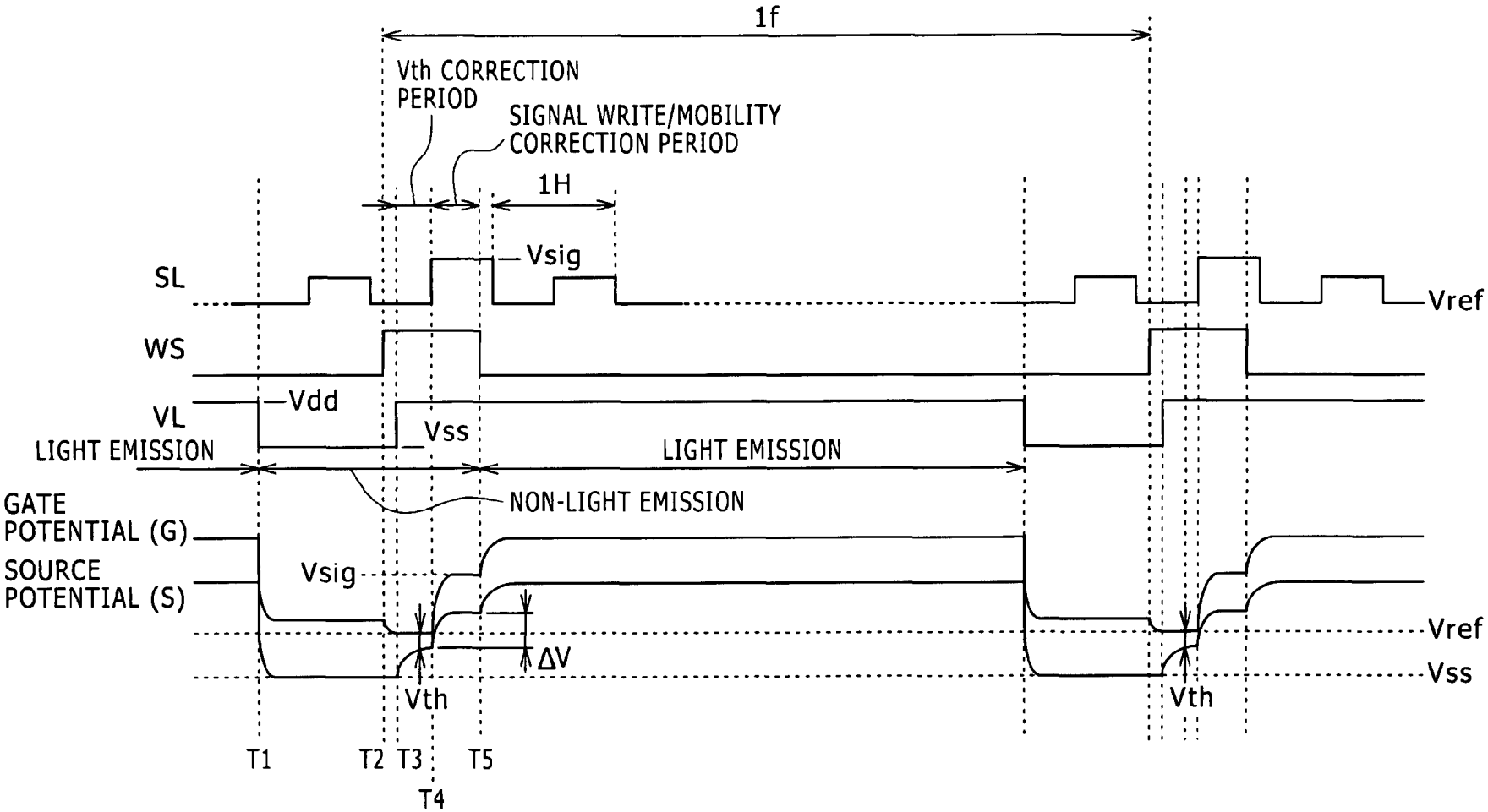
FIG. 23 is a timing chart used for describing the operation of the third embodiment of the display device according to an embodiment of the present invention.

FIG. 23 is a timing chart used for describing the operation of the pixel circuit 2 shown in FIG. 22. The timing chart illustrates changes in potential of the scanning line WS, power feed line VL and signal line SL on a common time axis. The timing chart also illustrates changes in potential of the gate G and source S of the drive transistor in parallel with the above changes in potential.

As mentioned earlier, the control signal pulse is applied to the scanning line WS to turn on the sampling transistor Tr1. This control signal pulse is applied to the scanning line WS every field (1f) in step with the line-sequentially scanning of the pixel array section. The power feed line VL changes between the high potential Vdd and low potential Vss every field. A video signal is supplied to the signal line SL. The video signal changes between the signal potential Vsig and reference potential Vref every horizontal interval (1H).

As illustrated in the timing chart of FIG. 23, the pixel enters the non-light emission period of the current field from the light emission period of the previous field. Then, the pixel enters the light emission period of the current field. During the non-light emission period, the pixel performs various operations, including preparatory operation, threshold voltage correction, signal writing and mobility correction.

During the light emission period of the previous field, the power feed line VL is at the high potential Vdd, causing the drive transistor Trd to supply the drive current Ids to the light-emitting device EL. The drive current Ids flows from the power feed line VL at the high potential through the light-emitting device via the drive transistor Trd into the cathode line.

Next, when the non-light emission period of the current field begins, the power feed line VL changes from the high potential Vdd to the low potential Vss at time T1. This discharges the power feed line VL down to Vss, further causing the potential of the source S of the drive transistor Trd to fall to Vss. As a result, the anode potential of the light-emitting device EL (i.e., source potential of the drive transistor Trd) is reverse-biased. This shuts off the drive current, causing the light-emitting device to stop emitting light. Further, the gate G of the drive transistor declines in potential with the decline in the potential of the source S of the same transistor.

Next at time T2, the scanning line WS changes from low to high level, bringing the sampling transistor Tr1 into conduction. At this time, the signal line SL is at the reference potential Vref. Therefore, the gate G of the drive transistor Trd drops in potential, via the conducting sampling transistor Tr1, to the reference voltage Vref at which the signal line SL is maintained. At this time, the potential of the source S of the drive transistor Trd is at Vss which is sufficiently lower than Vref. Thus, the voltage Vgs between the gate G and source S of the drive transistor Trd is initialized so that the same voltage Vgs is higher than the threshold voltage Vth of the drive transistor Trd. The period T1-T3 from time T1 to T3 is a preparatory period during which the voltage Vgs between the gate G and source S of the drive transistor Trd is set higher than the threshold voltage Vth of the drive transistor Trd.

Then at time T3, the power feed line VL changes from the low potential Vss to the high potential Vdd, thus causing the source S of the drive transistor Trd to start rising in potential. When the voltage Vgs between the gate G and source S of the drive transistor Trd reaches the threshold voltage Vth after a while, the current stops flowing. Thus, the voltage corresponding to the threshold voltage Vth of the drive transistor Trd is written to the holding capacitance Cs. This is the threshold voltage correction operation. At this time, the cathode potential Vcath is set so that the light-emitting device EL goes into cutoff to ensure that the majority of current flows through the holding capacitance Cs and little current flows through the light-emitting device EL. This threshold voltage correction operation is conducted at time T4 and complete before the signal line SL changes in potential from Vref to Vsig. The period T3-T4 from time T3 to T4 is the threshold voltage correction time.

At time T4, the signal line SL changes from the reference potential Vref to the signal potential Vsig. At this time, the sampling transistor Tr1 is still conducting. Therefore, the gate G of the drive transistor Trd rises in potential to the signal potential Vsig. Here, the light-emitting device EL is in cutoff (high impedance state) at first. Therefore, the majority of the current flowing from the drain to source of the drive transistor Trd flows into the holding capacitance Cs and the equivalent capacitance of the light-emitting device EL, thus starting to charge these capacitances. Thereafter, the source S of the drive transistor Trd rises in potential by ΔV by time T5 when the sampling transistor Tr1 turns off. Thus, the video signal potential Vsig is written to the holding capacitance Cs so that the same potential is added to Vth. At the same time, the mobility correction voltage ΔV is subtracted from the voltage held by the holding capacitance Cs. As a result, the period T4-T5 from time T4 to T5 is the signal write and mobility correction period. Thus, the signal potential Vsig is written, and the correction amount ΔV adjusted at the same time during the signal write period T4-T5. The higher Vsig becomes, the larger current Ids is supplied by the drive transistor Trd, and therefore the larger the absolute value of ΔV becomes. As a result, the mobility is corrected according to the light emission brightness. If Vsig is maintained constant, the larger the mobility μ of the drive transistor Trd becomes, the larger the absolute value of ΔV becomes. In other words, the larger the mobility μ becomes, the larger the negative feedback amount to the holding capacitance Cs becomes. This eliminates the variation in the mobility μ between the pixels.

Finally at time T5, the scanning line WS changes to low level, turning off the sampling transistor Tr1 as mentioned earlier. This disconnects the gate G of the drive transistor Trd from the signal line SL. At the same time, the drain current Ids begins to flow through the light-emitting device EL. This causes the anode potential of the same device EL to rise according to the drive current Ids. The rise of the anode potential of the light-emitting device EL is none other than the rise of the potential of the source S of the drive transistor Trd. As the source S of the drive transistor Trd rises in potential, the gate G of the same transistor Trd will also rise in potential because of the bootstrapping action of the holding capacitance Cs. The gate potential rises as much as the source potential does. As a result, the voltage Vgs between the gate G and source S of the drive transistor Trd is maintained constant during the light emission period. The Vgs level is equal to the level obtained by correcting the signal potential Vsig with the threshold voltage Vth and mobility μ.

Also in the present embodiment, the mobility correction period is defined to be from time T4 when the signal line SL changes in potential from Vref to Vsig to time T5 when the control signal WS falls to turn off the sampling transistor Tr1. Here, time T5 when the sampling transistor turns off is controlled according to the signal voltage Vsig supplied to the signal line SL. Therefore, the trailing edge waveform of the control signal WS needs to be sloped. In the present embodiment, for this reason, the write scanner 4 shown in FIG. 21 may have the configuration shown in FIG. 13. As mentioned earlier, the write scanner 4 shown in FIG. 13 uses the output buffer to vary the trailing edge waveform of the control signal WS at least in two steps. The control signal WS defines time T5 at which the sampling transistor Tr1 turns off. This makes it possible to variably control the mobility correction period t according to the video signal level Vsig.

Figure 24:
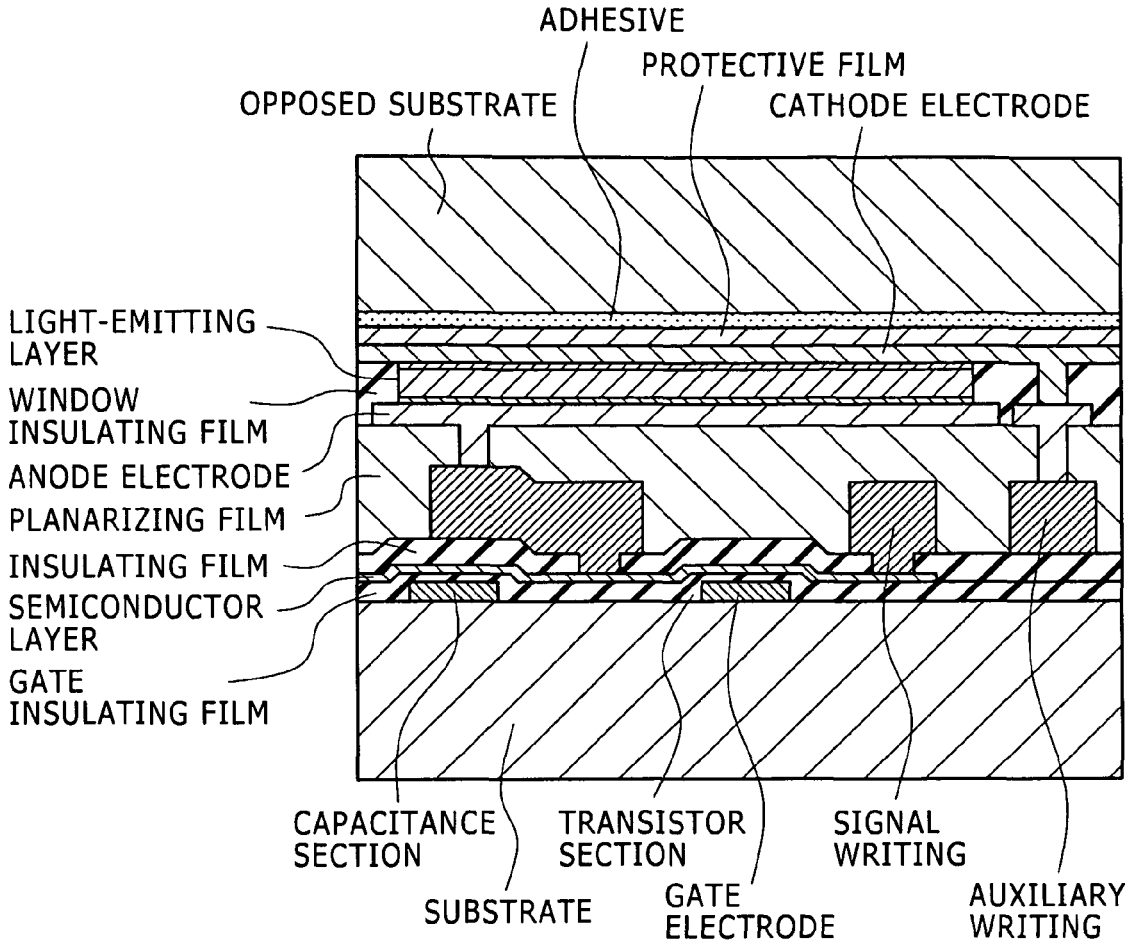
FIG. 24 is a sectional view illustrating the device configuration of the display device according to an embodiment of the present invention.

The display device according to an embodiment of the present invention has a thin film device configuration as illustrated in FIG. 24. FIG. 24 illustrates a schematic sectional structure of the pixel formed on an insulating substrate. As illustrated in FIG. 24, the pixel includes a transistor section (one TFT shown, as an example, in FIG. 24), capacitance section and light-emitting section. The transistor section includes a plurality of thin film transistors. The capacitance section includes, for example, the holding capacitance. The light-emitting section includes, for example, an organic EL device. The transistor and capacitance sections are formed on the substrate by the TFT process. On top thereof is laminated the light-emitting section which includes, for example, an organic EL device. Finally, a transparent opposed substrate is attached on top of the light-emitting section with adhesive, thus fabricating a flat panel.

Figure 25:
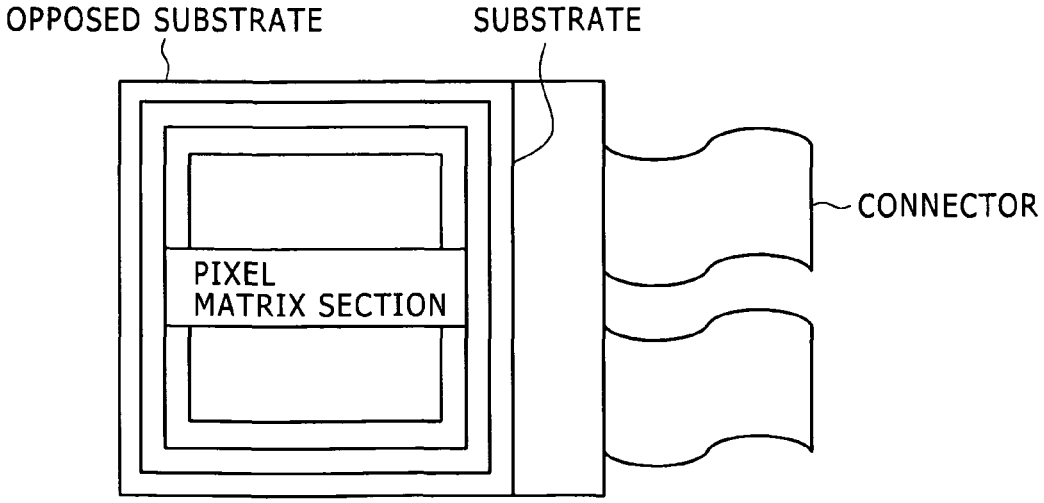
FIG. 25 is a plan view illustrating the modular configuration of the display device according to an embodiment of the present invention.

The display device according to an embodiment of the present invention includes that in a flat type modular form as illustrated in FIG. 25. For example, the pixel array section is provided on an insulating substrate. The same section includes pixels, each containing an organic EL device, thin film transistors and capacitances and other components, formed in an integrated matrix fashion. An adhesive is applied to enclose the pixel array section (pixel matrix section). Finally, an opposed substrate made, for example, of glass is attached to form a display module. A color filter, protective film or light-shielding film may be provided, for example, on the transparent opposed substrate. An FPC (flexible printed circuit) may be provided on the display module as necessary, to allow exchange of signals or other information between external equipment and the pixel array section.

The display device according to an embodiment of the present invention is in the form of a flat panel and applicable as a display device of electronic apparatus across all fields including a digital camera, laptop personal computer, mobile phone and video camcorder. These pieces of apparatus are designed to display an image or video of a video signal fed to or generated inside the electronic apparatus. Examples of electronic apparatus to which the display device is applied will be given below.

Figure 26:
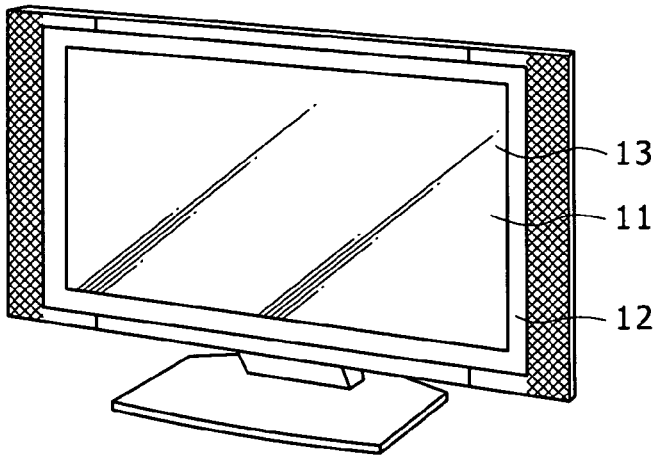
FIG. 26 is a perspective view illustrating a television set having the display device according to an embodiment of the present invention.

FIG. 26 illustrates a television set to which an embodiment of the present invention is applied. The television set includes a video display screen 11 made up, for example, of a front panel 12, filter glass 13 and other parts. The television set is manufactured by using the display device according to an embodiment of the present invention as the video display screen 11.

Figure 27:
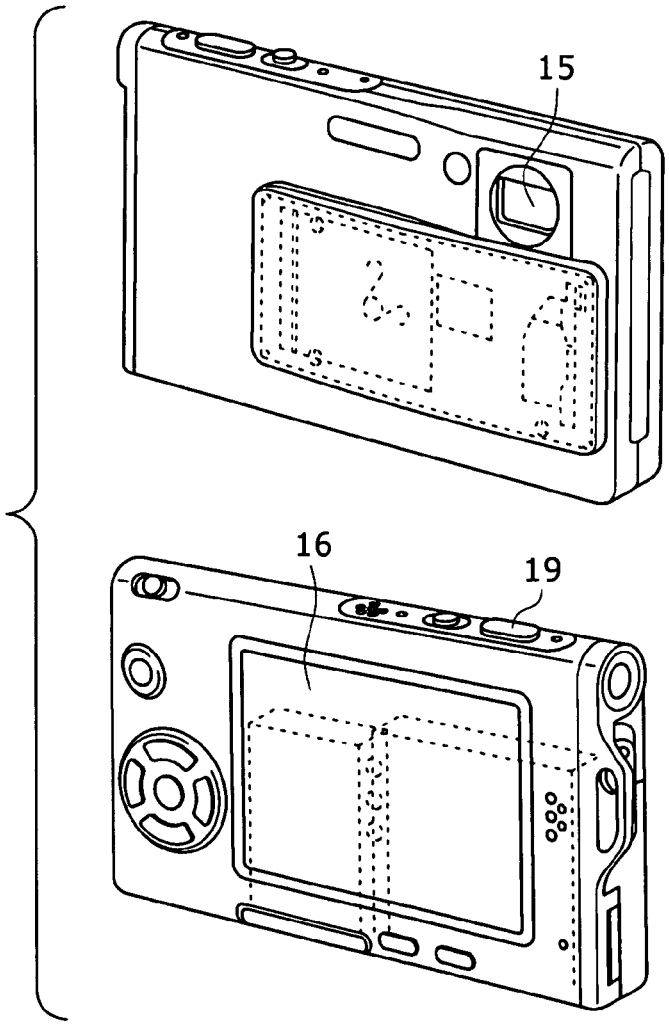
FIG. 27 is a perspective view illustrating a digital still camera having the display device according to an embodiment of the present invention.

FIG. 27 illustrates a digital camera to which an embodiment of the present invention is applied. A front view of the digital camera is shown at the top. A rear view thereof is shown at the bottom. The digital camera includes an imaging lens, flash-emitting section 15, display section 16, control switch, menu switch, shutter 19 and other parts. The digital camera is manufactured by using the display device according to an embodiment of the present invention as the display section 16.

Figure 28:
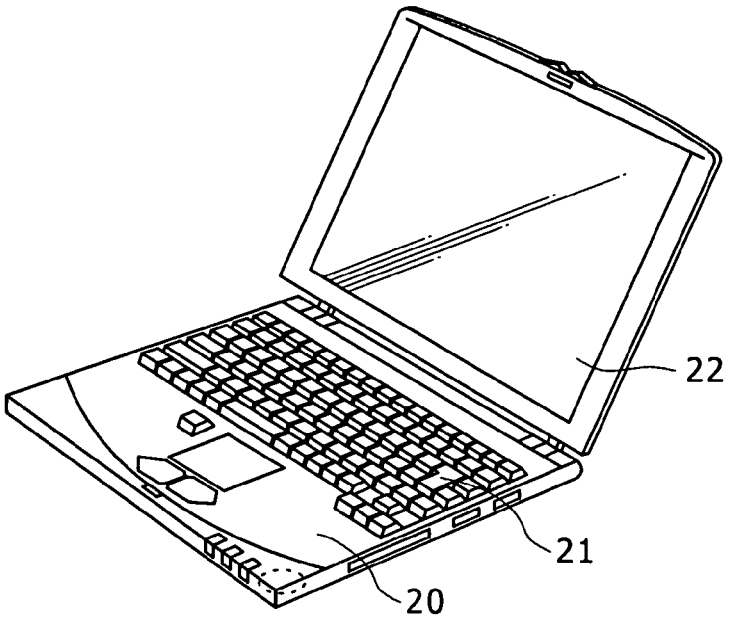
FIG. 28 is a perspective view illustrating a laptop personal computer having the display device according to an embodiment of the present invention.

FIG. 28 illustrates a laptop personal computer to which an embodiment of the present invention is applied. The laptop personal computer includes, in a main body 20, a keyboard 21 adapted to be manipulated for entry of text or other information. A main body cover thereof includes a display section 22 adapted to display an image. The laptop personal computer is manufactured by using the display device according to an embodiment of the present invention as the display section 22.

Figure 29:
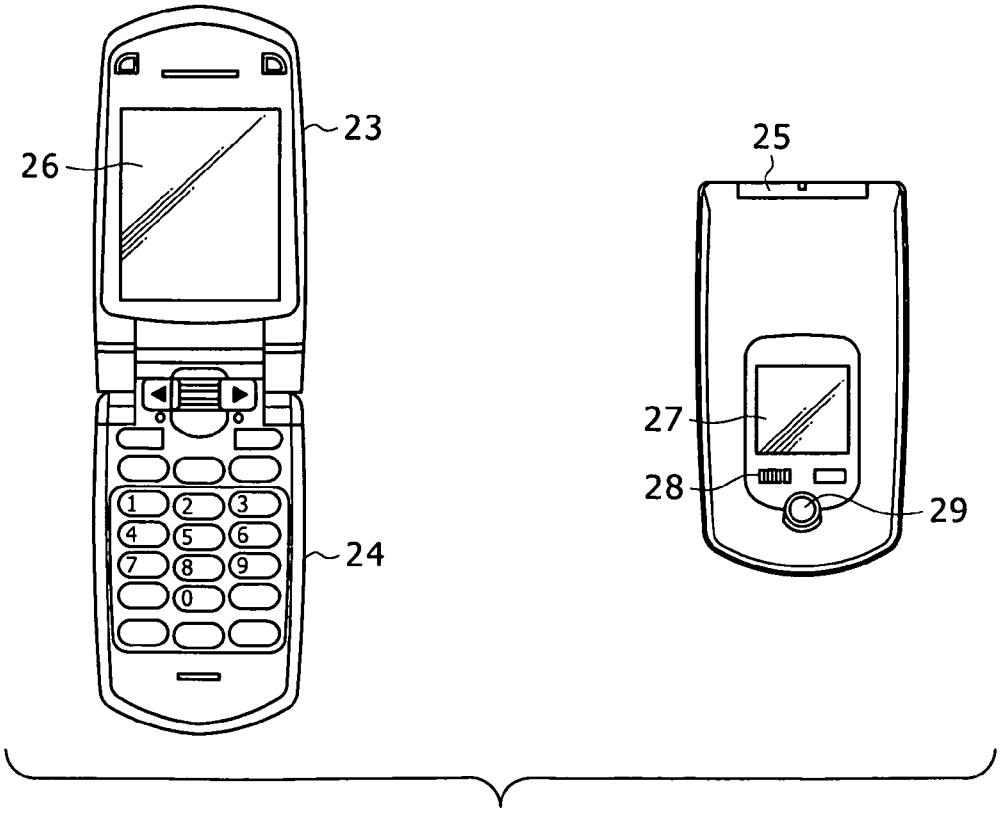
FIG. 29 is a perspective view illustrating a mobile terminal device having the display device according to an embodiment of the present invention.

FIG. 29 illustrates a mobile terminal device to which an embodiment of the present invention is applied. The mobile terminal device is shown in an open position on the left and in a closed position on the right. The mobile terminal device includes an upper enclosure 23, lower enclosure 24, connecting section (hinge section in this example) 25, display 26, subdisplay 27, picture light 28, camera 29 and other parts. The mobile terminal device is manufactured by using the display device according to an embodiment of the present invention as the display 26 and subdisplay 27.

Figure 30:
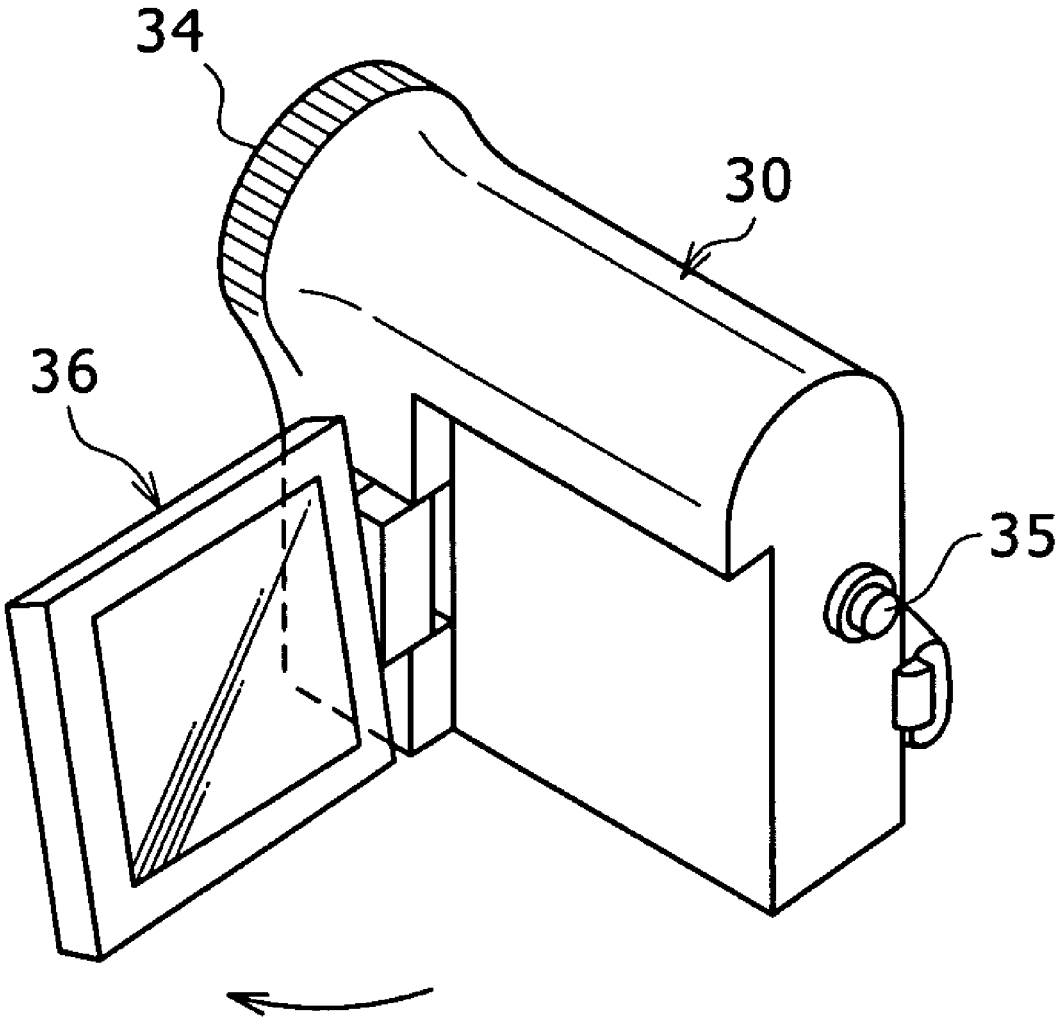
FIG. 30 is a perspective view illustrating a video camcorder having the display device according to an embodiment of the present invention.

FIG. 30 illustrates a video camcorder to which an embodiment of the present invention is applied. The video camcorder includes a main body section 30, lens 34 provided on the front-facing side surface to image the subject, imaging start/stop switch 35, monitor 36 and other parts. The video camcorder is manufactured by using the display device according to an embodiment of the present invention as the monitor 36.

It should be understood by those skilled in the art that various modifications, combinations, sub-combinations and alternations may occur depending on design requirements and other factors insofar as they are within the scope of the appended claims or the equivalent thereof.

What is claimed is:

1. A display device comprising:

a pixel array section and a driving section;

the pixel array section including scanning lines arranged in rows, signal lines arranged in columns, and pixels arranged in a matrix, each of the pixels being disposed at the intersection of one of the scanning lines and one of the signal lines;

each of the pixels including at least a sampling transistor, a drive transistor, a holding capacitance, and a light-emitting device, wherein the sampling transistor has its control terminal connected to the scanning line and its pair of current terminals connected between the signal line and the control terminal of the drive transistor, the drive transistor has one of its pair of current terminals connected to the light-emitting device and the other of its pair of current terminals connected to a power source, and the holding capacitance is connected between the control and current terminals of the drive transistor;

the driving section including at least a write scanner adapted to sequentially supply a control signal to each of the scanning lines for line-sequentially scanning, and a signal selector adapted to supply a video signal to each of the signal lines, wherein the sampling transistor turns on in response to the control signal supplied to the scanning line to sample the video signal from the signal line and write the sampled video signal to the holding capacitance, the sampling transistor negatively feeds the current flowing from the drive transistor back to the holding capacitance during a given correction period lasting until the sampling transistor turns off in response to the control signal so as to apply the correction of the mobility of the drive transistor to the video signal written to the holding capacitance, the drive transistor supplies a current appropriate to the video signal level written to the holding capacitance to the light-emitting device so as to cause the light-emitting device to emit light, wherein the write scanner includes a shift register and output buffers, the shift register sequentially generates an input signal from each of its stages in synchronism with line-sequentially scanning, each of the output buffers is connected between one of the stages of the shift register and one of the scanning lines and outputs a control signal to the scanning line in response to the input signal, and the output buffer varies the trailing edge waveform of the control signal, adapted to define the timing at which the sampling transistor turns off, at least in two steps in response to the input signal so as to variably control the correction period according to the video signal level.

2. The display device of claim 1, wherein the output buffer includes an inverter and at least one additional N-channel transistor, the inverter including a P-channel transistor and N-channel transistor connected in series between a power line and ground line, the additional N-channel transistor being connected in parallel with the N-channel transistor of the inverter, and the output buffer controls the on/off operations of the N-channel transistors in response to the input signal to vary the trailing edge waveform of the control signal at least in two steps.

3. The display device of claim 1, wherein the shift register adjusts the input signal to adjust the on/off timings of the N-channel transistors so as to optimize the trailing edge waveform of the control signal.

4. The display device of claim 1, wherein the N-channel transistors of the output buffer are adjusted in size in advance to optimize the optimal trailing edge waveform of the control signal.

5. A driving method for a display device, the display device including a pixel array section and a driving section, the pixel array section including scanning lines arranged in rows, signal lines arranged in columns, and pixels arranged in a matrix, each of the pixels being disposed at the intersection of one of the scanning lines and one of the signal lines, each of the pixels including at least a sampling transistor, a drive transistor, a holding capacitance, and a light-emitting device, wherein the sampling transistor has its control terminal connected to the scanning line and its pair of current terminals connected between the signal line and the control terminal of the drive transistor, the drive transistor has one of its pair of current terminals connected to the light-emitting device and the other of its pair of current terminals connected to a power source, and the holding capacitance is connected between the control and current terminals of the drive transistor, the driving section including at least a write scanner adapted to supply a control signal to each of the scanning lines for line-sequentially scanning and a signal selector adapted to supply a video signal to each of the signal lines, wherein the sampling transistor turns on in response to the control signal supplied to the scanning line to sample the video signal from the signal line and write the sampled video signal to the holding capacitance, the sampling transistor negatively feeds the current flowing from the drive transistor back to the holding capacitance during a given correction period lasting until the same transistor turns off in response to the control signal so as to apply the correction of the mobility of the drive transistor to the video signal written to the holding capacitance, the drive transistor supplies a current appropriate to the video signal level written to the holding capacitance to the light-emitting device so as to cause the light-emitting device to emit light, the method comprising the step of:

providing the write scanner including a shift register and output buffers;

sequentially generating an input signal from each of the stages of the shift register in synchronism with line-sequentially scanning;

outputting a control signal to the scanning lines in response to the input signal from each of the output buffers connected between one of the stages of the shift register and one of the scanning lines; and allowing the output buffer to vary the trailing edge waveform of the control signal, adapted to define the timing at which the sampling transistor turns off, at least in two steps in response to the input signal so as to variably control the correction period according to the video signal level.

6. Electronic apparatus comprising:

a display device including a pixel array section and a driving section;

the pixel array section including scanning lines arranged in rows, signal lines arranged in columns, and pixels arranged in a matrix, each of the pixels being disposed at the intersection of one of the scanning lines and one of the signal lines;

each of the pixels including at least a sampling transistor, a drive transistor, a holding capacitance, and a light-emitting device, wherein the sampling transistor has its control terminal connected to the scanning line and its pair of current terminals connected between the signal line and the control terminal of the drive transistor, the drive transistor has one of its pair of current terminals connected to the light-emitting device and the other of its pair of current terminals connected to a power source, and the holding capacitance is connected between the control and current terminals of the drive transistor;

the driving section including at least a write scanner adapted to sequentially supply a control signal to each of the scanning lines for line-sequentially scanning, and a signal selector adapted to supply a video signal to each of the signal lines, wherein the sampling transistor turns on in response to the control signal supplied to the scanning line to sample the video signal from the signal line and write the sampled video signal to the holding capacitance, the sampling transistor negatively feeds the current flowing from the drive transistor back to the holding capacitance during a given correction period lasting until the sampling transistor turns off in response to the control signal so as to apply the correction of the mobility of the drive transistor to the video signal written to the holding capacitance, the drive transistor supplies a current appropriate to the video signal level written to the holding capacitance to the light-emitting device so as to cause the light-emitting device to emit light, wherein the write scanner includes a shift register and output buffers, the shift register sequentially generates an input signal from each of its stages in synchronism with line-sequentially scanning, each of the output buffers is connected between one of the stages of the shift register and one of the scanning lines and outputs a control signal to the scanning line in response to the input signal, and the output buffer varies the trailing edge waveform of the control signal, adapted to define the timing at which the sampling transistor turns off, at least in two steps in response to the input signal so as to variably control the correction period according to the video signal level.

* * * * *